US009079736B1

(12) United States Patent
Muir et al.

(10) Patent No.: US 9,079,736 B1
(45) Date of Patent: Jul. 14, 2015

(54) WRINKLE REDUCTION SYSTEM USING BERNOULLI FORCE ROLLERS

(71) Applicants: Christopher M. Muir, Rochester, NY (US); David James Cornell, Scottsville, NY (US)

(72) Inventors: Christopher M. Muir, Rochester, NY (US); David James Cornell, Scottsville, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/190,127

(22) Filed: Feb. 26, 2014

(51) Int. Cl.

| | |
|---|---|
| ***B65H 5/22*** | (2006.01) |
| ***B65H 3/66*** | (2006.01) |
| ***B65H 3/10*** | (2006.01) |
| ***B65H 5/36*** | (2006.01) |
| ***B65H 7/16*** | (2006.01) |

(52) U.S. Cl.
CPC .. *B65H 3/66* (2013.01); *B65H 3/10* (2013.01); *B65H 5/22* (2013.01); *B65H 5/36* (2013.01); *B65H 7/16* (2013.01)

(58) Field of Classification Search
CPC .... B65H 9/166; B65H 5/228; B65H 23/0322; B65H 23/0324; B65H 23/044; B65H 23/26; B65H 20/10; B65H 20/14; B65H 2404/1316; B65H 2404/13161; B65H 2404/132; B65H 2404/1321; B65H 2406/12; B65H 2406/122; B65H 2406/33; B65H 2406/3511
See application file for complete search history.

(56) References Cited

U.S. PATENT DOCUMENTS

| | | | | |
|---|---|---|---|---|
| 3,342,481 | A | 9/1967 | Kaplan | |
| 3,405,855 | A | 10/1968 | Daly et al. | |
| 3,567,093 | A | 3/1971 | Johnson | |
| 4,165,132 | A | 8/1979 | Hassan | |
| 4,231,272 | A | 11/1980 | Crouse | |
| 4,322,026 | A | 3/1982 | Young, Jr. | |
| 4,542,842 | A | 9/1985 | Reba | |
| 5,036,737 | A | 8/1991 | Glaser | |
| 5,246,155 | A | 9/1993 | Barrois | |
| 5,979,731 | A | 11/1999 | Long et al. | |
| 6,125,754 | A | 10/2000 | Harris | |
| 6,305,772 | B1 | 10/2001 | Berkoben et al. | |
| 6,427,941 | B1 | 8/2002 | Hikita | |
| 8,303,106 | B2 | 11/2012 | Kasiske et al. | |
| 8,936,243 | B1 * | 1/2015 | Muir et al. | 271/302 |
| 2003/0049042 | A1 | 3/2003 | Bogoshian | |
| 2011/0135405 | A1 | 6/2011 | Miyaji et al. | |
| 2013/0341858 | A1 | 12/2013 | Herrmann | |

FOREIGN PATENT DOCUMENTS

| | | | |
|---|---|---|---|
| WO | 2004-74148 | A2 | 9/2004 |

* cited by examiner

*Primary Examiner* — Michael McCullough
(74) *Attorney, Agent, or Firm* — Kevin E. Spaulding

(57) ABSTRACT

A wrinkle-reduction system includes two media guiding rollers located in proximity to first and second edges of a media, each media guiding roller having a corresponding roller axis and having one or more grooves formed around its exterior surface. The media travels along a transport path past the media-guiding rollers with a first side of the media facing the exterior surface of the web-guiding rollers. Air sources provide an air flow into the grooves in the media-guiding rollers, the air flow being directed between the first side of the media and the exterior surface of the media-guiding rollers thereby producing a Bernoulli force to draw the media toward the media-guiding rollers. The first roller axis is not parallel to the second roller axis such that when the air sources are activated the media guiding rollers impart a lateral stretching force to the media in the cross-track direction.

19 Claims, 21 Drawing Sheets

WRINKLE REDUCTION SYSTEM USING BERNOULLI FORCE ROLLERS

CROSS REFERENCE TO RELATED APPLICATIONS

Reference is made to commonly assigned, co-pending U.S. patent application Ser. No. 14/016,427, entitled "Positive pressure web wrinkle reduction system," by Kasiske Jr., et al.; to commonly assigned, co-pending U.S. patent application Ser. No. 14/190,146, entitled "Air shoe with roller providing lateral constraint," by Cornell et al.; to commonly assigned, co-pending U.S. patent application Ser. No. 14/190,153, entitled "Air shoe with integrated roller," by Cornell et al.; to commonly assigned, co-pending U.S. patent application Ser. No. 14/190,125, entitled "Media guiding system using Bernoulli force roller," by Muir et al.; and to commonly assigned, U.S. patent application Ser. No. 14/190,137, now U.S. Pat. No. 8,936,243, entitled "Media diverter system using Bernoulli force rollers," by Muir et al., each of which is incorporated herein by reference.

FIELD OF THE INVENTION

This invention pertains to the field of media transport and more particularly to an apparatus for reducing wrinkles in a web of receiver media using rollers that impart a Bernoulli force to the receiver media.

BACKGROUND OF THE INVENTION

In a digitally controlled inkjet printing system, a receiver media (also referred to as a print medium) is conveyed past a series of components. The receiver media can be a cut sheet of receiver media or a continuous web of receiver media. A web or cut sheet transport system physically moves the receiver media through the printing system. As the receiver media moves through the printing system, liquid (e.g., ink) is applied to the receiver media by one or more printheads through a process commonly referred to as jetting of the liquid. The jetting of liquid onto the receiver media introduces significant moisture content to the receiver media, particularly when the system is used to print multiple colors on a receiver media. Due to the added moisture content, an absorbent receiver media expands and contracts in a non-isotropic manner, often with significant hysteresis. The continual change of dimensional characteristics of the receiver media can adversely affect image quality. Although drying is used to remove moisture from the receiver media, drying can also cause changes in the dimensional characteristics of the receiver media that can also adversely affect image quality.

FIG. 1 illustrates a type of distortion of a receiver media 3 that can occur during an inkjet printing process. As the receiver media 3 absorbs the water-based inks applied to it, the receiver media 3 tends to expand. The receiver media 3 is advanced through the system in an in-track direction 4. The perpendicular direction, within the plane of the un-deformed receiver media, is commonly referred to as the cross-track direction 7. Typically, as the receiver media 3 expands in the cross-track direction 7, contact between the receiver media 3 and contact surface 8 of rollers 2 (or other web guiding components) in the inkjet printing system can produce sufficient friction such that the receiver media 3 is not free to slide in the cross-track direction 7. This can result in localized buckling of the receiver media 3 away from the rollers 2 to create lengthwise flutes 5, also called ripples or wrinkles, in the receiver media 3. Wrinkling of the receiver media 3 during the printing process can lead to permanent creases in the receiver media 3 which adversely affects image quality.

U.S. Pat. No. 3,405,855 to Daly et al., entitled "Paper guide and drive roll assemblies," discloses a web guiding apparatus having peripheral venting grooves to vent air carried by the underside of the traveling web.

U.S. Pat. No. 4,322,026 to Young, Jr., entitled "Method and apparatus for controlling a moving web," discloses a method for smoothing and guiding a web in which the web is moved in an upward direction past pressurized fluid discharge manifolds on either side of the web. The manifolds direct continuous streams of pressurized fluid, such as air, outwardly toward the side edges of the web to smooth wrinkles in the web. Additional manifolds are used to intermittently direct streams of fluid to laterally move and guide the web.

U.S. Pat. No. 4,542,842 to Reba, entitled "Pneumatic conveying method for flexible webs," discloses a method for conveying a web using inner and outer pairs of side jet nozzles employing the Coanda effect to propel the web while preventing undue distortion.

U.S. Pat. No. 5,979,731 to Long et al., entitled "Method and apparatus for preventing creases in thin webs," discloses an apparatus for removing longitudinal wrinkles from a thin moving web of media. The media is wrapped around a perforated cylindrical air bar disposed in proximity to a contact roller.

U.S. Pat. No. 6,427,941 to Hikita, entitled "Web transporting method and apparatus," discloses a web transporting apparatus that transports a web by floating the web on air jetted from holes formed in a roller while the edges of the web are supported by edge rollers.

There remains a need for a means to prevent the formation of receiver media wrinkles as a receiver media contacts web-guiding structures in a digital printing system.

SUMMARY OF THE INVENTION

The present invention represents a wrinkle-reduction system for reducing wrinkles in a media travelling from upstream to downstream along a transport path in an in-track direction, the media having a first side and an opposing second side, comprising:

a first media-guiding roller having a first roller axis and an exterior surface having one or more grooves formed around the exterior surface, wherein the first media travels along the transport path past the first media-guiding roller with the first side of the media facing the exterior surface of the first web-guiding roller;

a first air source for providing an air flow into one or more of the grooves in the first media-guiding roller, the air flow being directed between the first side of the media and the exterior surface of the first media-guiding roller thereby producing a Bernoulli force to draw the media toward the exterior surface of the first media-guiding roller and providing an increased fraction between the media and the first media-guiding roller;

a second media-guiding roller having a first second axis and an exterior surface having one or more grooves formed around the exterior surface, wherein the media travels along the transport path past the second media-guiding roller with the first side of the media facing the exterior surface of the second web-guiding roller; and a second air source for providing an air flow into one or more of the grooves in the second media-guiding roller, the air flow being directed between the first side of the media and the exterior surface of the second media-guiding roller thereby producing a Bernoulli force to draw the media toward the exterior surface of the second media-guiding roller and providing an increased traction between the media and the second media-guiding roller;

wherein the first media-guiding roller is located in proximity to a first edge of the media and the second media-guiding roller is located in proximity to an opposite second edge of the media, both the first and second media-guiding rollers have widths in the direction of their respective roller axis which are less than 20% of a cross-track width of the web of media; and wherein the first roller axis is not parallel to the second roller axis such that when the first and second air sources are activated the traction between the media and the first and second media guiding rollers imparts a lateral stretching force to the media in the cross-track direction.

This invention has the advantage that adequate traction between the media and the media-guiding rollers can be produced to provide wrinkle reduction even when there is minimal wrap of the media around the media-guiding roller.

It has the additional advantage that in various embodiments the wrinkle-reduction system can also be used to steer the media.

It has the further advantage that it can reduce fluttering in receiver media webs that can result from insufficient traction between media-guiding rollers and the receiver media web in prior art systems.

DETAILED DESCRIPTION OF THE INVENTION

Figure 1:
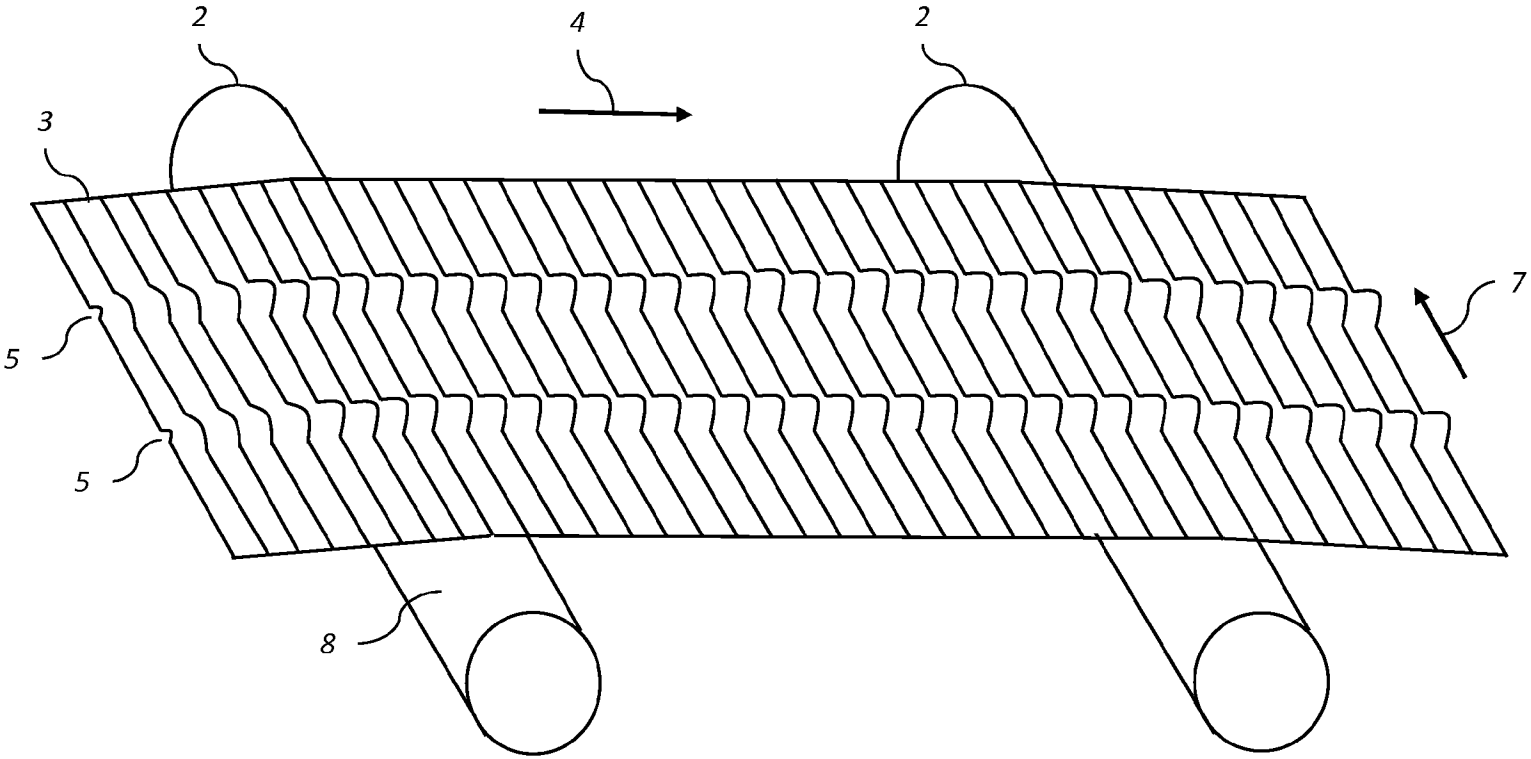
FIG. 1 (Prior Art)
FIG. 1 illustrates the formation of flutes in a continuous web of receiver media due to cross-track expansion of the receiver media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The example embodiments of the present invention are illustrated schematically and may not be to scale for the sake of clarity. One of ordinary skill in the art will be able to readily determine the specific size and interconnections of the elements of the example embodiments of the present invention.

As described herein, the exemplary embodiments of the present invention provide receiver media guiding components useful for guiding the receiver media in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard and corrugated cardboard can comprise the receiver media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a receiver media. Typically, one of two types of ink jetting mechanisms is used, and is categorized by technology as either drop-on-demand inkjet printing or continuous inkjet printing.

Drop-on-demand inkjet printing provides ink drops that impact upon a recording surface using a pressurization actuator, for example, a thermal, piezoelectric or electrostatic actuator. One commonly practiced drop-on-demand inkjet type uses thermal energy to eject ink drops from a nozzle. A heater, located at or near the nozzle, heats the ink sufficiently to form a vapor bubble that creates enough internal pressure to eject an ink drop. This form of inkjet is commonly termed "thermal inkjet." A second commonly practiced drop-on-demand inkjet type uses piezoelectric actuators to change the volume of an ink chamber to eject an ink drop.

The second technology commonly referred to as "continuous" inkjet printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous inkjet printing type uses thermal stimulation of the liquid jet with a heater to form drops that eventually become printing drops and non-printing drops. Printing occurs by selectively deflecting either the printing drops or the non-printing drops and catching the non-printing drops using catchers. Various approaches for selectively deflecting drops have been developed including electrostatic deflection, air deflection, and thermal deflection.

There are typically two types of receiver media used with inkjet printing systems. The first type of receiver media is in the form of a continuous web, while the second type of receiver media is in the form of cut sheets. The continuous web of receiver media refers to a continuous strip of receiver media, generally originating from a source roll. The continuous web of receiver media is moved relative to the inkjet printing system components using a web transport system, which typically include drive rollers, web guide rollers, and web tension sensors. Cut sheets refer to individual sheets of receiver media that are moved relative to the inkjet printing system components via rollers and drive wheels or via a conveyor belt system that is routed through the inkjet printing system.

The invention described herein is applicable to both drop-on-demand and continuous inkjet printing technologies that print on continuous webs of receiver media. As such, the term "printhead" as used herein is intended to be generic and not specific to either technology. Additionally, the invention described herein is also applicable to other types of printing systems, such as offset printing and electrophotographic printing, that print on continuous webs of receiver media.

The terms "upstream" and "downstream" are terms of art referring to relative positions along the transport path of the receiver media; points on the receiver media move along the transport path from upstream to downstream.

Figure 2:
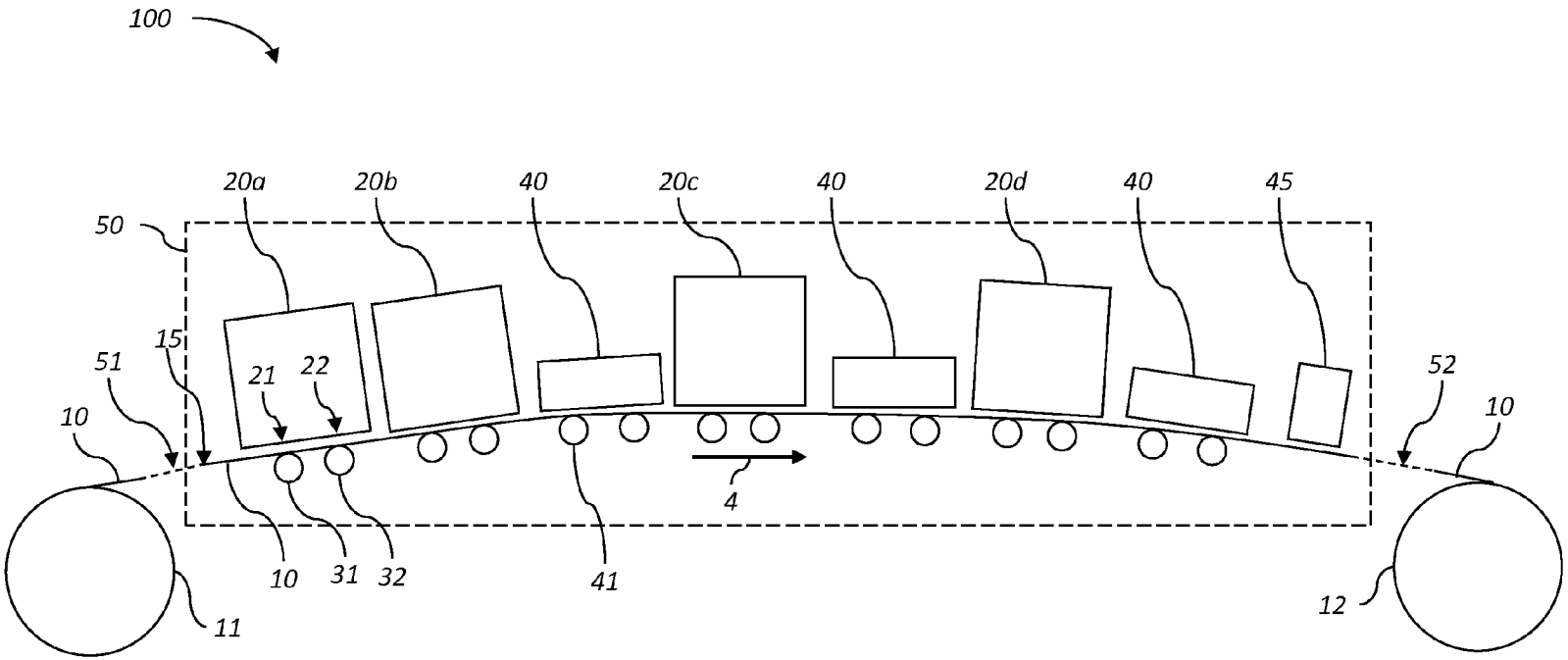
FIG. 2 is a simplified side view of an inkjet printing system.

Referring to FIG. 2, there is shown a simplified side view of a portion of a digital printing system 100 for printing on a first side 15 of a continuous web of receiver media 10. The printing system 100 includes a printing module 50 which includes printheads 20*a*, 20*b*, 20*c*, 20*d*, dryers 40, and a quality control sensor 45. In this exemplary system, the first printhead 20*a* jets cyan ink, the second printhead 20*b* jets magenta ink, the third printhead 20*c* jets yellow ink, and the fourth printhead 20*d* jets black ink.

Below each printhead 20*a*, 20*b*, 20*c*, 20*d* is a media guide assembly including print line rollers 31 and 32 that guide the continuous web of receiver media 10 past a first print line 21 and a second print line 22 as the receiver media 10 is advanced along a media path in the in-track direction 4. Below each dryer 40 is at least one dryer roller 41 for controlling the position of the web of receiver media 10 near the dryers 40.

Receiver media 10 originates from a source roll 11 of unprinted receiver media 10, and printed receiver media 10 is wound onto a take-up roll 12. Other details of the printing module 50 and the printing system 100 are not shown in FIG. 2 for simplicity. For example, to the left of printing module 50, a first zone 51 (illustrated as a dashed line region in receiver media 10) can include a slack loop, a web tensioning system, an edge guide and other elements that are not shown. To the right of printing module 50, a second zone 52 (illustrated as a dashed line region in receiver media 10) can include a turnover mechanism and a second printing module similar to printing module 50 for printing on a second side of the receiver media 10.

Figure 3:
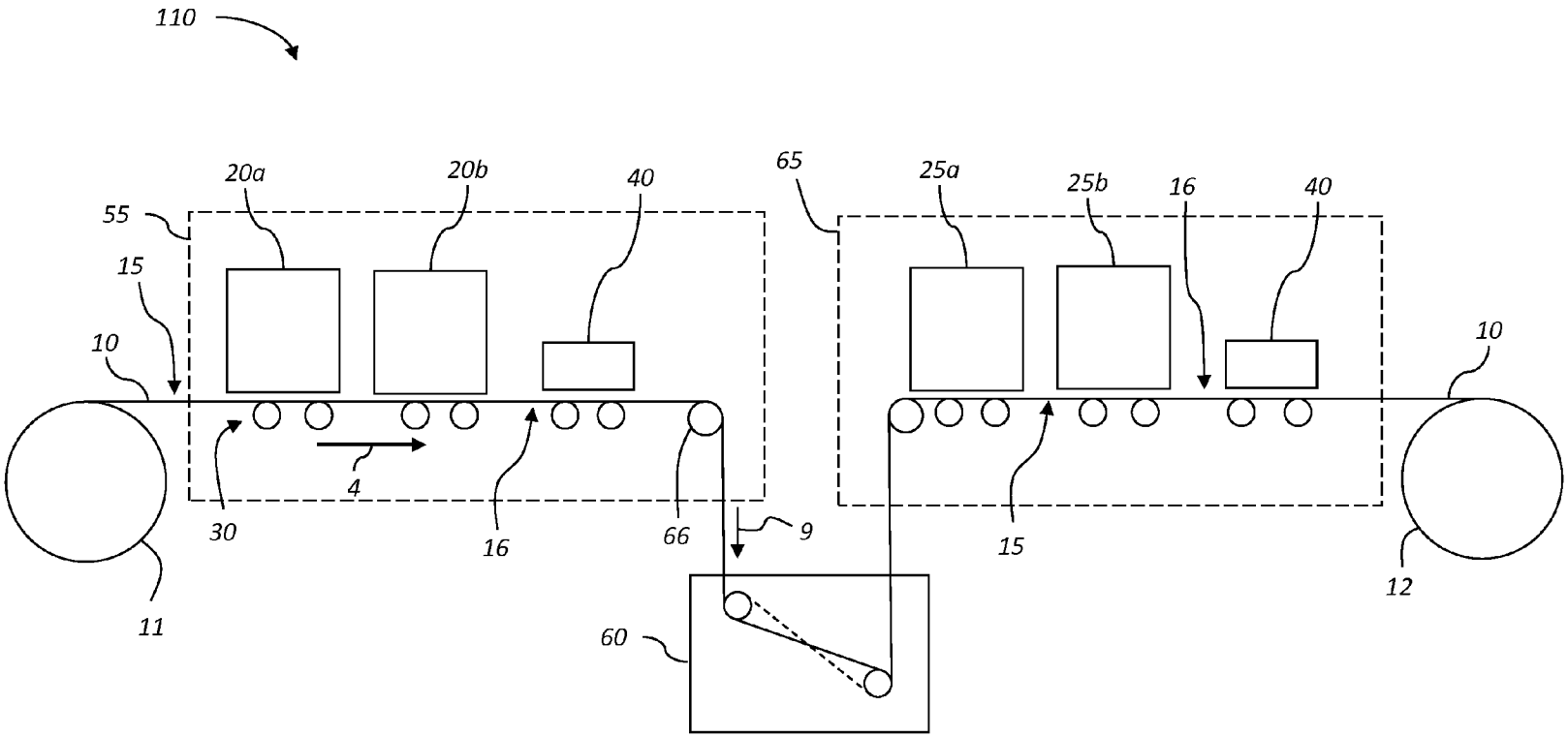
FIG. 3 is a simplified side view of an inkjet printing system for printing on both sides of a web of receiver media.

Referring to FIG. 3, there is shown a simplified side view of a portion of a printing system 110 for printing on both a first side 15 and a second side 16 of a continuous web of receiver media 10. Printing system 110 includes a first printing module 55, for printing on a first side 15 of the continuous web, having two printheads 20*a*, 20*b* and a dryer 40; a turnover mechanism 60; and a second printing module 65, for printing on the second side of the continuous web, having two printheads 25*a* and 25*b* and a dryer 40. A web-guiding system 30 guides the web of receiver media 10 from upstream to downstream along a transport path in an in-track direction 4 past through the first printing module 55 and the second printing module 65. The web-guiding system 30 includes rollers aligned with the print lines of the printheads 20*a*, 20*b*, 25*a*, and 25*b*. These rollers maintain the receiver media 10 at a fixed spacing from the printing modules to ensure a consistent time of flight for the print drops emitted by the printheads. The web-guiding system 30 also includes a web-guiding structure 66, which can be a roller for example, positioned near the exit of first printing module 55 for redirecting a direction of travel of the web of receiver media 10 along exit direction 9 in order to guide web of receiver media 10 toward the turnover mechanism 60. The movement of the receiver media of the guiding rollers of the web guide system also maintains the cross-track position of the continuous web provided there is sufficient traction between the continuous web and the guiding rollers.

Figure 4:
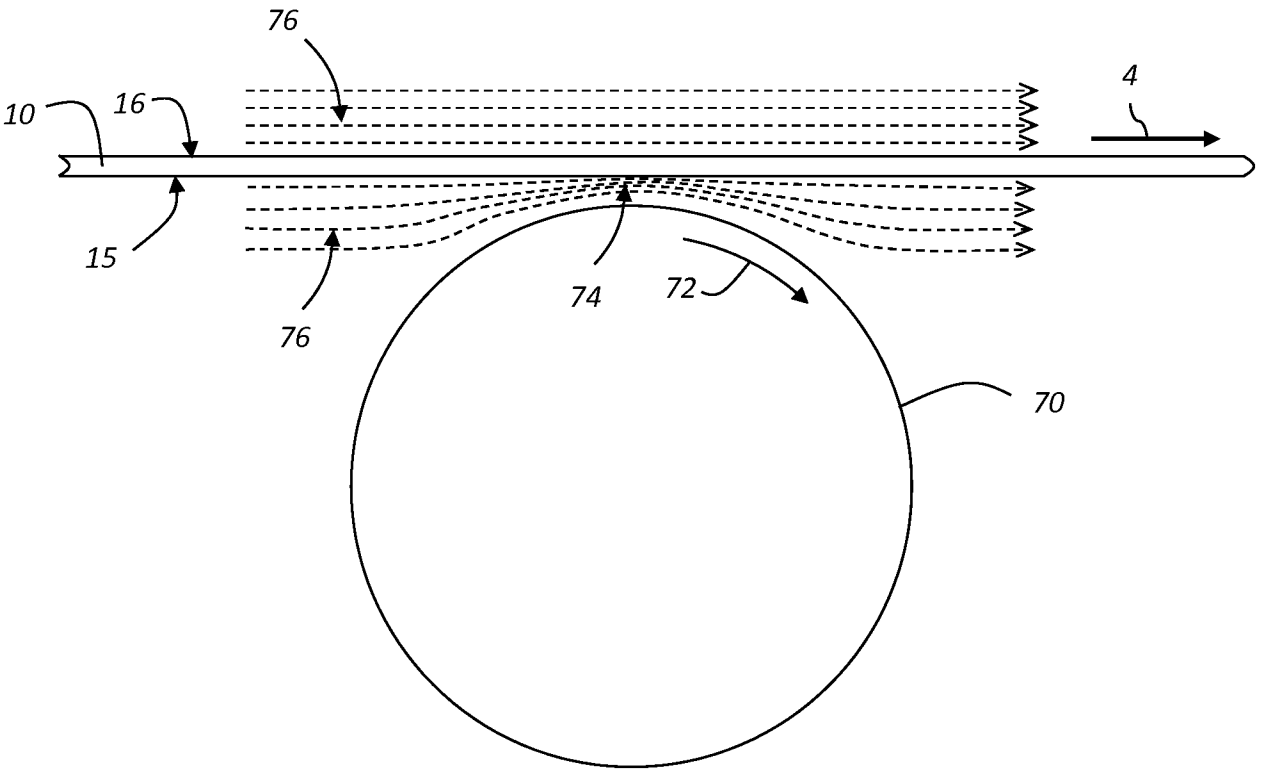
FIG. 4 shows a schematic side view of a prior art media-guiding system.

FIG. 4 shows a side view of prior art system where a continuous web of receiver media 10 moves in an in-track direction 4 past a media-guiding roller 70 rotating in a rotation direction 72. As the continuous web moves through the air its motion can entrain a flow of air, denoted by entrained airflow 76, causing the entrained air to move together with the receiver media along both the first side 15 and the second side 16 of the receiver media 10. The velocity of the entrained airflow 76 at the surfaces of the receiver media 10 is approximately equal to the velocity of the receiver media 10, and the velocity of the entrained airflow 76 drops off with increasing distance from the receiver media 10.

If there is insufficient wrap of the web of receiver media 10 around the media-guiding roller 70 or insufficient tension in the web of receiver media 10, the entrained airflow 76 can cause the receiver media 10 to float free of the media-guiding roller 70 on a thin air cushion 74 of the entrained air, and can induce fluttering of the receiver media 10, a vibration of the receiver media 10 perpendicular to the in-track direction 4 and the cross-track direction 7 (FIG. 1). When the receiver media 10 is floating free of the media-guiding roller 70, the media-guiding roller 70 is no longer able to provide a lateral constraint on the web of receiver media 10, allowing the receiver media 10 to drift in the cross-track direction 7.

To avoid these stability problems, U.S. Pat. No. 3,405,855 to Daly Jr. et al., entitled "Paper guide and drive roll assemblies," introduced grooves into the media contact surface of the media-guiding roller 70. The air entrained by the moving web of receiver media 10 can flow into the grooves of the roller, allowing the web of receiver media 10 to contact the contact surface of the media-guiding roller 70 in the area between the grooves. There are times when design constraints of the printing system are such that little or no wrap is possible around a media-guiding roller 70. In such printing systems, it has been found that even the use of a grooved guiding roller is insufficient to ensure traction between the receiver media 10 and the grooved surface of the media-guiding roller 70. Such printing systems are therefore susceptible to cross-track wander of the receiver media 10, and also to media flutter. The present invention overcomes the limitations of such prior art web-guiding systems.

Figure 5:
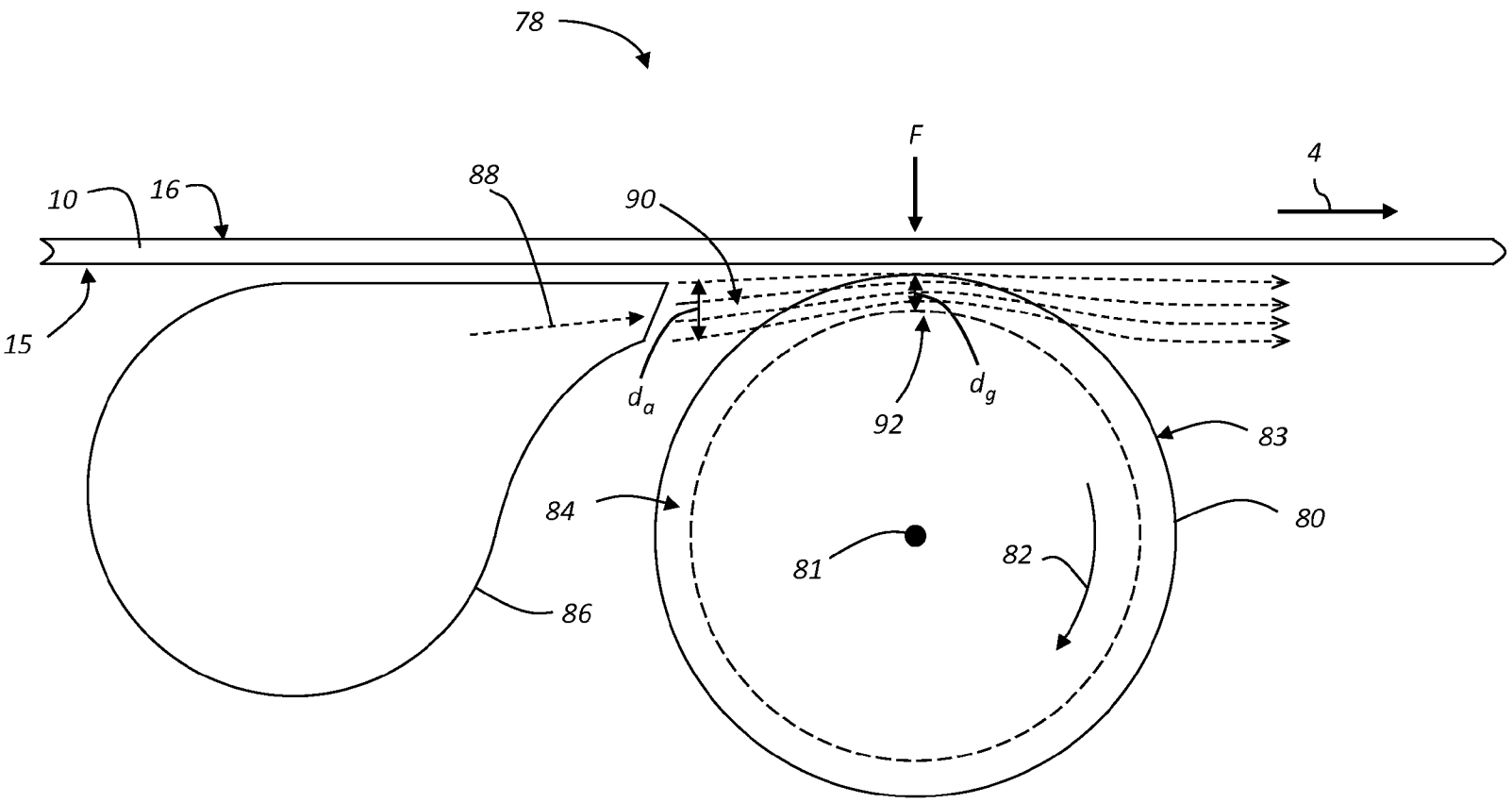
FIG. 5 shows a schematic side view of a media-guiding system in accordance with an embodiment of the present invention.

FIG. 5 is a schematic side view of a media-guiding system 78 according to an embodiment the present invention, showing a portion of the receiver media 10 as it passes by a media-guiding roller 80 having a roller axis 81 and rotating in a rotation direction 82. The media-guiding roller 80 has one or more grooves 84 formed around its exterior surface 83. The grooves 84 are typically aligned parallel to the direction of the surface rotation of the media-guiding roller 80, so that the grooves 84 extend around the circumference of media-guiding roller 80. First side 15 of the receiver media 10 faces toward the exterior surface 83 of the media-guiding roller 80, while the second side 16 faces away from the media-guiding roller 80. An air source 86 directs a flow of air 88 into the one or more grooves 84 providing an airflow 90. In a preferred embodiment, the airflow 90 is substantially parallel to the plane of the receiver media 10 (i.e., a vector representing the direction of airflow 525 is within about 10° of being parallel to the plane of the receiver media 10) and to the grooves 84 (i.e., a vector representing the direction of airflow 90 is within about 10° of being parallel to a plane through the center of the groove 84, where the plane through the center of the groove 84 will generally be perpendicular to the roller axis 81.)

The one or more grooves 84 serve as air channels for the airflow 90. As the airflow 90 passes through a groove 84 between the first side 15 of receiver media 10 and the exterior surface 83 of the media-guiding roller 80, the contour of the bottom of the groove 84 forms a constriction 92 to the airflow 90. The well-known "continuity principle" of fluid dynamics requires the airflow 90 to accelerate as it passes through the constriction 92. According to the well-known Bernoulli's Principle, the increased velocity of the airflow 90 at the constriction 92 is accompanied by the development of a low pressure zone between the high point of the groove 84 and the receiver media 10. A pressure differential is therefore developed from the second side 16 to the first side 15 of the receiver media 10, resulting in a Bernoulli force F on the receiver media 10 which draws the receiver media 10 down toward, or into contact with, the exterior surface 83 of the media-guiding roller 80. As a result, the media-guiding roller 80 is able to provide a lateral constraint on the web of receiver media 10, preventing the receiver media 10 from drifting in the cross-track direction 7 (FIG. 1).

An advantage provided by the media-guiding system 78 of the present invention is that all of the system components are located on one side of the receiver media 10. This is useful in many systems where there are tight geometric constraints.

In some embodiments, the media-guiding roller 80 is a passive roller having no drive mechanism so that it rotates freely in response to traction with the receiver media 10. In other embodiments, a drive mechanism (not shown) can be used to rotate the media-guiding roller 80 around its roller axis 81. In such configurations, the media-guiding roller 80 can be used to impart a force on the receiver media 10 to move it along the transport path in the in-track direction 4. Driven media-guiding rollers 80 are of particular value when the receiver media 10 is in the form of cut sheets, as the intermittent passage of individual sheets past the media-guiding roller 80 may be insufficient to maintain the rotation of the media-guiding roller.

Figure 6:
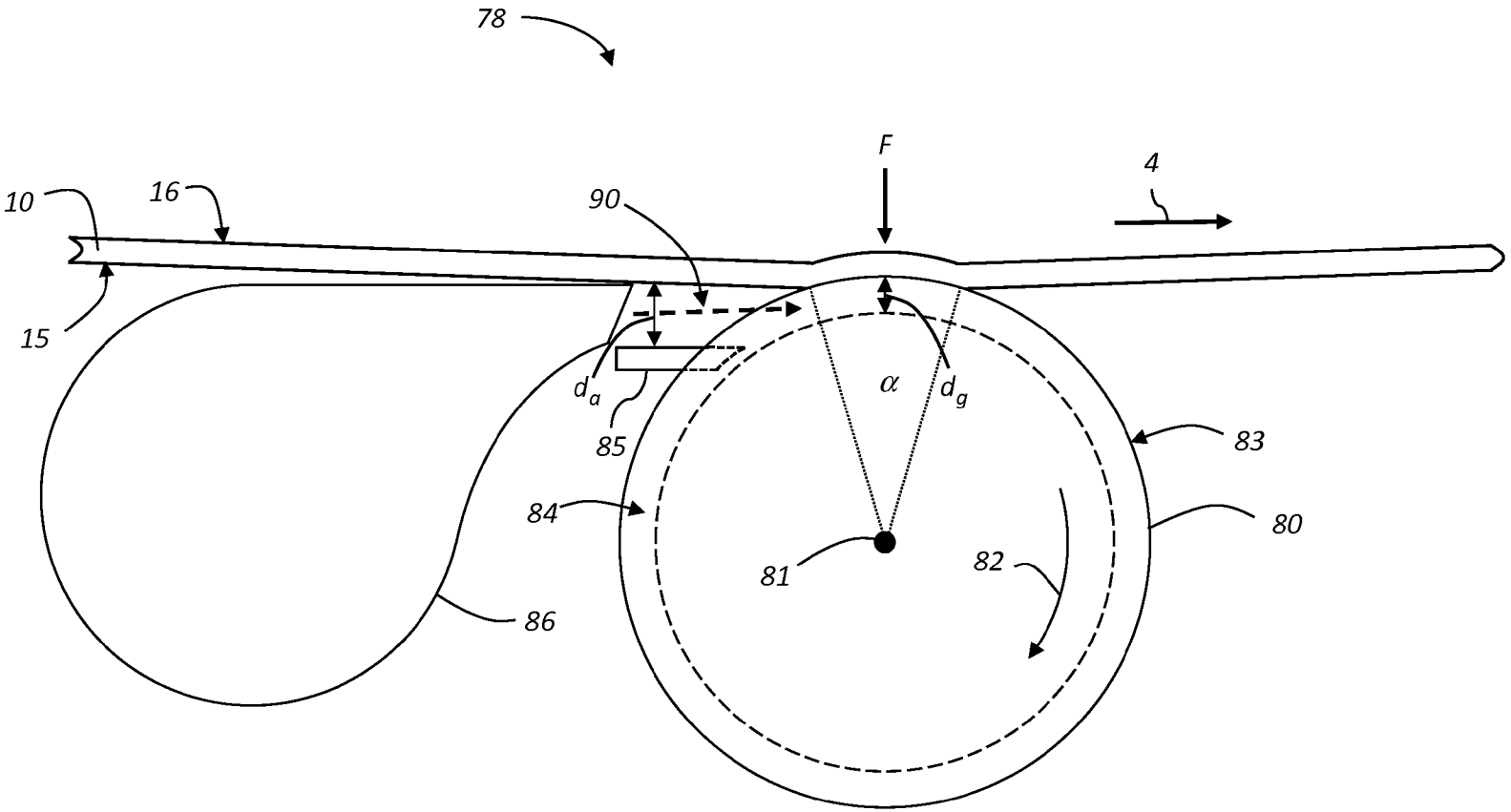
FIG. 6 illustrates the media-guiding system of FIG. 5 being operated to draw the receiver media down onto the media-guiding roller.

FIG. 6 illustrates the media-guiding system 78 of FIG. 5 being operated such that the airflow 90 from the air source 86 is being directed into the one or more grooves 84 of the media-guiding roller 80, thereby causing the receiver media 10 to be deflected downward into contact with the exterior surface 83 of the media-guiding roller 80 as a result of the Bernoulli force F. In some embodiments, an optional airflow guide 85 can be provided to channel the airflow 90 into the grooves 84. The receiver media 10 is shown as contacting the exterior surface 83 of the media-guiding roller 80 for a wrap angle of $\alpha$. While a larger wrap angle is shown in FIG. 6 for clarity, in practice, the wrap angle $\alpha$ will typically be less than about 5°, and will often be less than about 2°. In some embodiments, if the air source 86 is turned off so that it doesn't provide any airflow 90, the receiver media 10 may be separated from the exterior surface 83 of the media-guiding roller 80 by a small gap as shown in FIG. 5, or may contact the media-guiding roller 80 with a small wrap angle (e.g., between 0° and 2°).

Commonly-assigned U.S. patent application Ser. No. 14/016,427, entitled: "Positive pressure web wrinkle reduction system," by Kasiske Jr., et al, describes a web-guiding system where an air source is used to direct an airflow through a pattern of recesses in a web-guiding structure. The described configurations prevent wrinkles from forming in the receiver media as it passes around the web-guiding structure by causing portions of the receiver media overlying the recesses to lift away from the web-guiding structure. In some of the embodiments described by Kasiske Jr., et al., the recesses are grooves similar to those described with respect to FIG. 5 in the present disclosure. Whether the airflow 90 through the grooves 84 produces a Bernoulli force F to draws the receiver media 10 down toward the media-guiding roller 80, or whether it produces a lifting force to lift the portions of the receiver media 10 overlying the grooves 84 away from the media-guiding roller 80 will depend on a number of different factors including the wrap angle of the receiver media 10, the rate of the airflow 90, the geometry of the grooves 84, and the presence of any blockages to block air flow from passing through the grooves. Generally, it has been found that an adequate downward Bernoulli force F results for relatively small wrap angles (e.g., less than about) 5-10° and for open grooves having no blockages, whereas a lifting force results for relatively large wrap angles, particularly when blockages (e.g, fingers 91 in FIG. 15 of Kasiske Jr., et al.) are inserted into the grooves to block the airflow 90.

In an exemplary embodiment, the media-guiding roller 80 has a radius of 2.5 inches, the grooves 84 have a groove width $w_g$ of 0.375 inches and a groove depth $d_g$ of 0.125 inches. The exit of the air source 86 is preferably sized such that the width of the opening is approximately the same as the groove width $w_g$, and the height of the opening is somewhat larger than the groove depth $d_g$ of the grooves 84 to provide an airflow depth $d_a$ that will be reduced as it passes through the constriction 92 in order to accelerate the airflow 90 and produce the Bernoulli force F. In the exemplary embodiment, the groove depth $d_g$ is smaller than the airflow depth $d_a$ by about 20% (i.e., the airflow depth $d_a$ entering the grooves 84 is about 0.150 inches). In other embodiments, other air flow depths $d_a$ can be used to provide different amounts of constriction. For example, in some embodiments the groove depth $d_g$ can be smaller than the airflow depth $d_a$ entering the grooves 84 by about 10-50%.

The magnitude of the Bernoulli force F will be related to magnitude of the airflow 90 provided into of the grooves 84, together with the amount of constriction 92 the airflow 90 experiences as it passes by the grooves 84. In an exemplary embodiment, it has been found that an acceptable Bernoulli force F to guide the receiver media 10 with the media-guiding roller 80 is obtained when the air source 86 provides an airflow 90 having a velocity of about 100-400 m/s, although different velocities can be used depending on the geometry of the grooves 84 and the requirements of the particular application.

Figure 7:
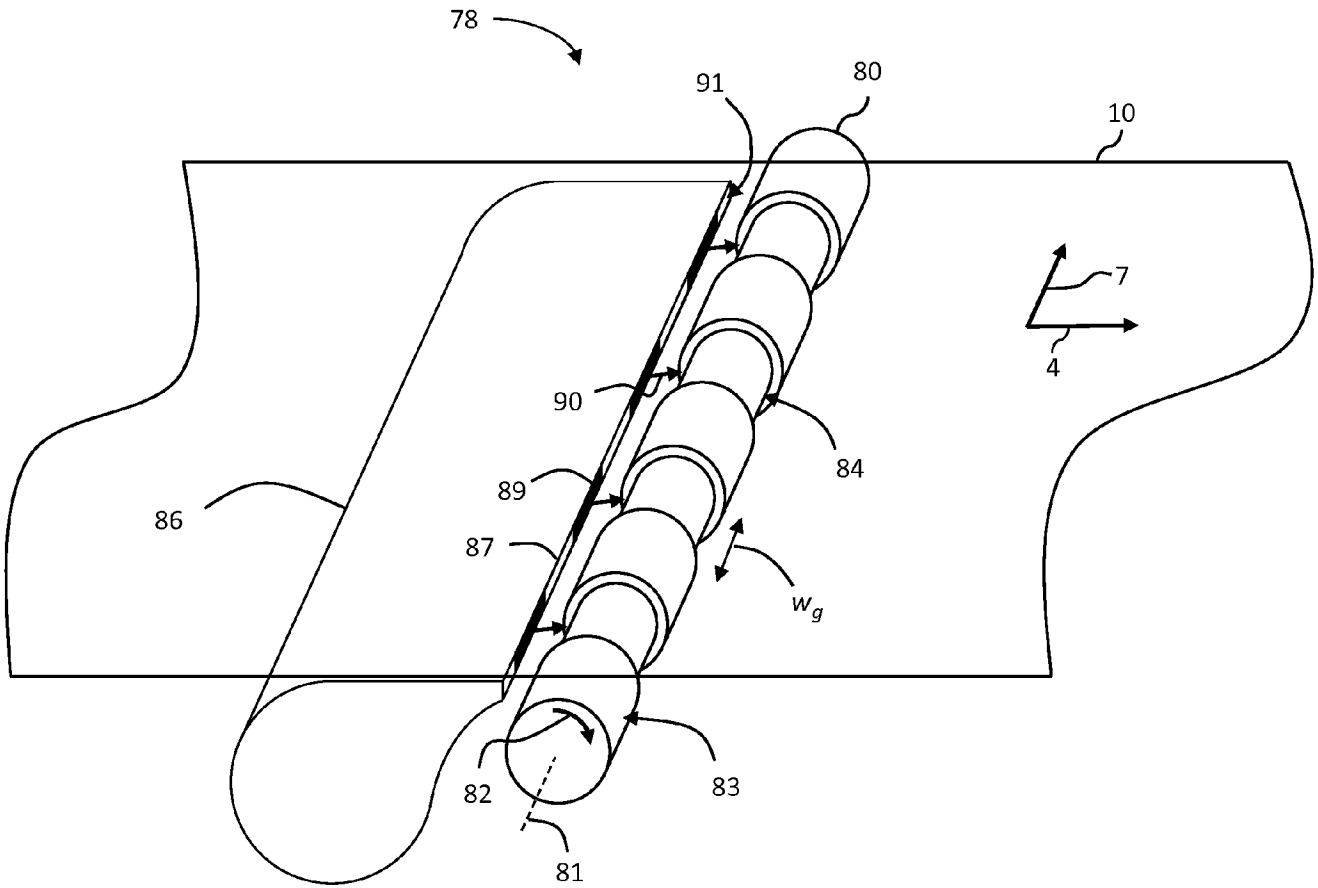
FIGS. 7 and 8 are perspective drawings of the media-guiding system of FIG. 5 illustrating two different air source configurations.
Figure 8:
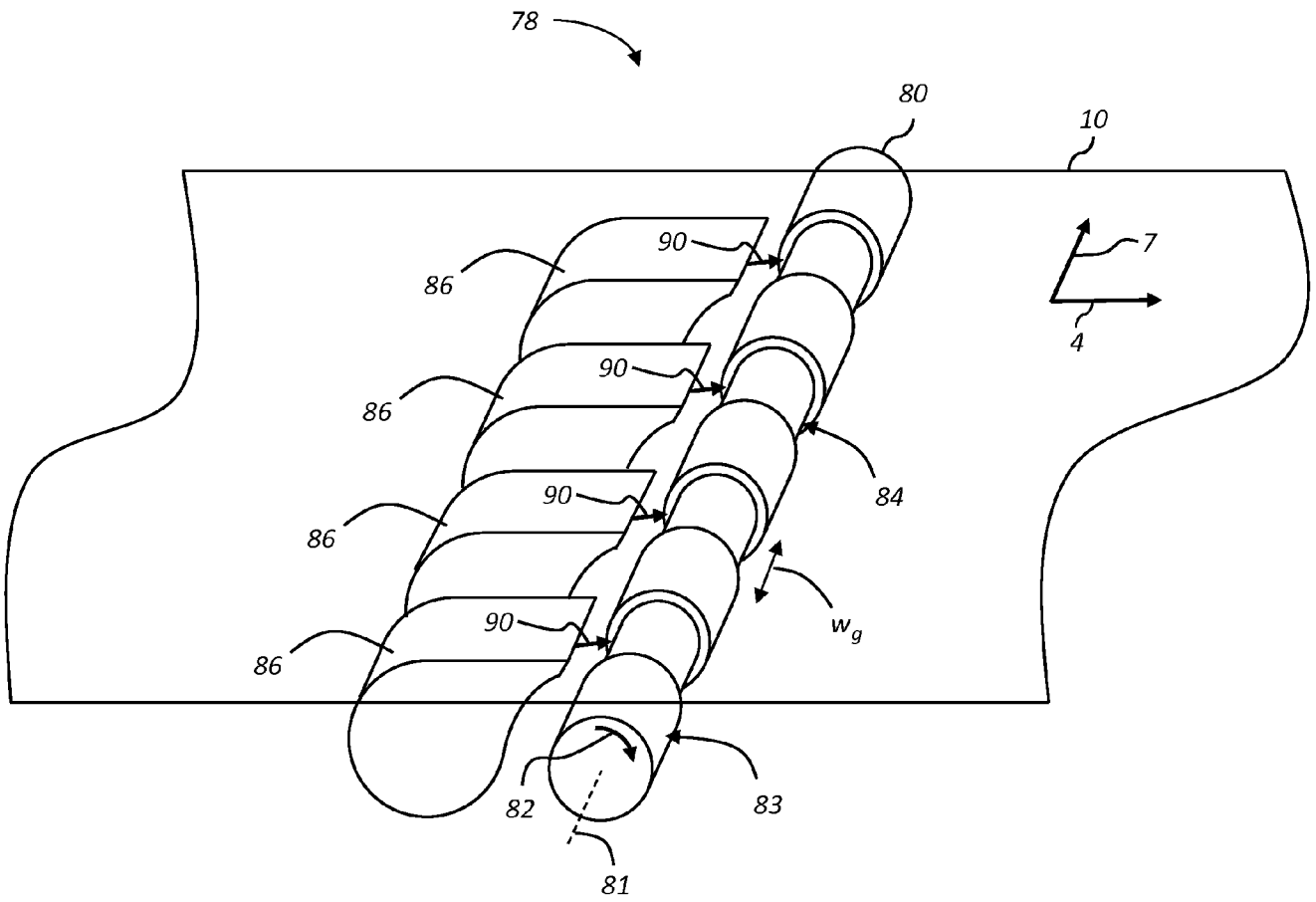

FIGS. 7 and 8 show two different embodiments for the air source 86 that directs airflow 90 into the grooves 84 of the media-guiding roller 80. The air source 86 of the FIG. 7 embodiment uses a common plenum 91 to direct the air flow into each of the grooves. The plenum 91 is partitioned by barriers 87 to form individual openings 89 aligned with the grooves 84. In FIG. 8, a plurality of individual air sources 86 are used to direct airflow 90 into corresponding grooves 84 of the media-guiding roller 80. This approach has the advantage that it enables the flow rate of the airflow 90 to be adjusted or turned off on a groove-by-groove basis (e.g., to account for different media widths). In the illustrated embodiments, the grooves 84 are shown as having sharp corners at the top and bottom edges. In alternate embodiments, the grooves 84 can have rounded corners at one or both of the top or bottom edges. This can have the advantage that it will be less likely to crease the receiver media 10 when it is pulled down into the grooves 84.

The media-guiding system 78 can be used to provide a variety of media control process functions. For example, in some printing systems 110 (FIG. 3), the web-guiding structure 66 can be an air shoe which enables the receiver media to travel around the web-guiding structure 66 at least partially on a cushion of air. While this can provide various advantages such as reducing the likelihood of wrinkling the receiver media 10, the lack of traction between the receiver media and the air shoe removes a lateral constraint on the receiver media 10, allowing the receiver media to drift in the cross-track direction as it passes around the air shoe. In some embodiments, the media-guiding system 78 can be positioned in proximity to the air shoe to provide a lateral constraint to the receiver media 10 in close proximity to the air shoe in order to stabilize the cross-track position of the receiver media as the media passes around the air shoe. In an exemplary embodiment, the media-guiding system 78 of the present invention can be used with the air shoe configuration described in commonly assigned, co-pending U.S. patent application Ser. No. 14/190,146, entitled "Air shoe with lateral constraint," by Cornell et al., which is incorporated herein by reference.

Figure 9:
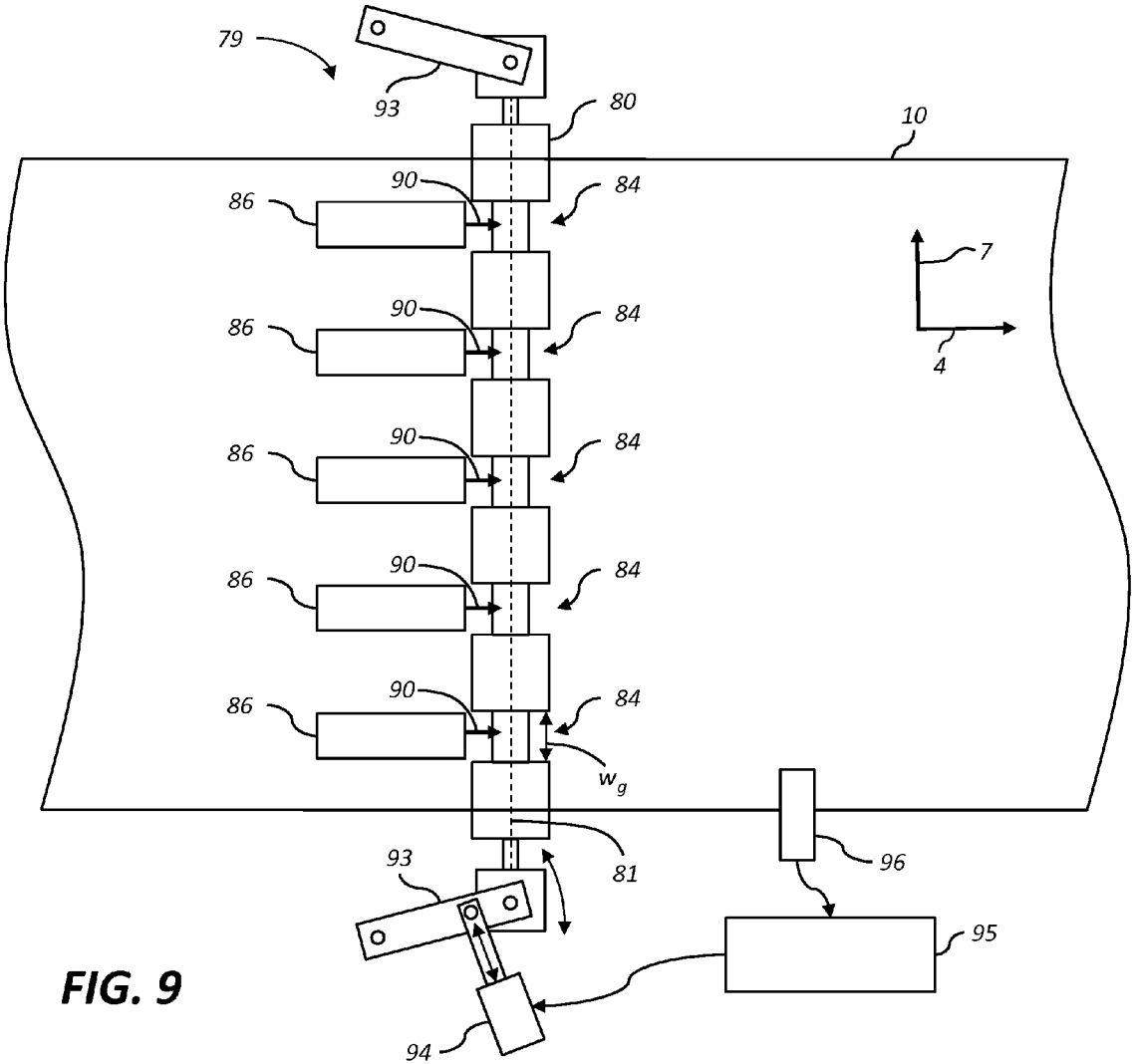
FIG. 9 illustrates an alternate embodiment of a media-guiding system where an orientation of the roller axis can be adjusted to steer the receiver media.

FIG. 9 illustrates an embodiment of a media-guiding system 79 in which the roller axis 81 of the media-guiding roller 80 can be tilted using a roller control mechanism. In particular, the media-guiding roller 80 is mounted on pivot arms 93 that can be steered by an actuator 94. A steering controller 95 receives signals from one or more media edge detectors 96 and provides signals to the actuator 94 thereby enabling the web of receiver media 10 to be steered to follow a desired path. For example, if the media edge detector 96 detects that the receiver media 10 is starting to drift to one side, then the steering controller 95 can cause the actuator 94 to tilt the roller axis 81 of the media-guiding roller 80, thereby steering the receiver media 10 to compensate for the drift. Due to the airflow 90 through the grooves 84 of the media-guiding roller 80, the receiver media 10 can be brought into sufficient contact with the media-guiding roller 80 to have the traction needed for the media-guiding roller 80 to be able to steer the web of receiver media 10. The present invention has the advantage that a sufficient steering force can be provided, even in systems where there is minimal wrap around the steered media-guiding roller 80.

When the actuator 94 tilts the media-guiding roller 80 so that the roller axis 81 is oriented in a non-orthogonal direction relative to the in-track direction 4 (i.e., in a direction that is not parallel to the cross-track direction 7), when the air source 86 is activated the traction between the media-guiding roller 80 and the receiver media 10 will steer the web of receiver media 10 in accordance with the tilt direction. In the configuration shown in FIG. 9, if the bottom portion of the roller axis 81 is tilted toward the left side of the figure, then the receiver media 10 will be steered (i.e., deflected) toward the bottom side of the figure. Conversely, if the bottom portion of the roller axis 81 is tilted toward the right side of the figure, then the receiver media 10 will be steered toward the top side of the figure. When the roller axis 81 is oriented in a substantially orthogonal direction relative to the in-track direction 4 (i.e., the roller axis 81 is substantially parallel to the cross-track direction 7), or if the airflow 90 is turned off, the receiver media 10 will be maintained at its current cross-track position.

Figure 10:
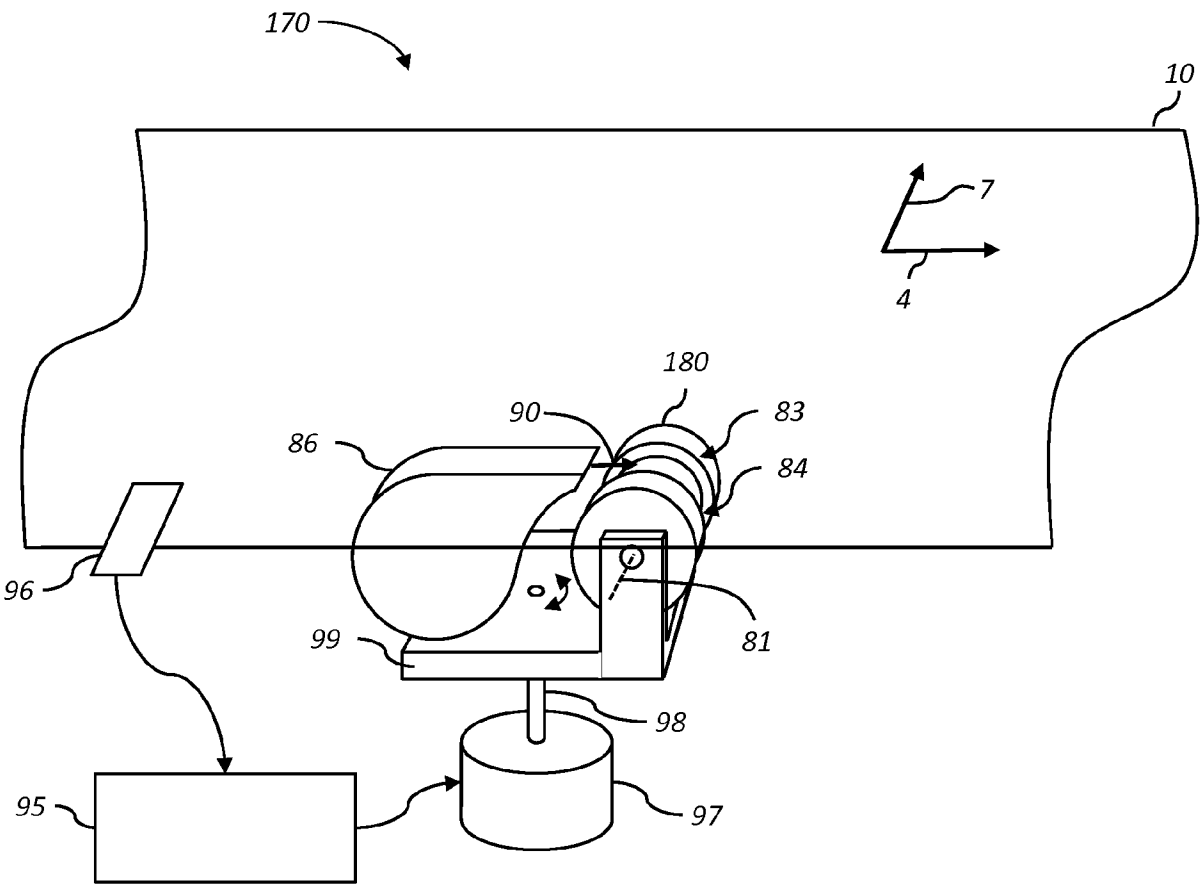
FIG. 10 illustrates a media-guiding system according to an alternate embodiment featuring a narrow media-guiding roller having an adjustable roller axis orientation.

In the configurations shown in FIGS. 7-9, the media-guiding roller 80 spans the entire cross-track width of the receiver media 10. FIG. 10 shows an embodiment of a media-guiding system 170 that uses a narrow media-guiding roller 180, having a single groove 84 in its exterior surface 83. In this case, the width of media-guiding roller 180 in the cross-track direction 7 spans only a relatively small fraction (e.g., less than 20%) of the cross-track width of the receiver media 10. This type of media-guiding roller 180 is sometimes referred to as a "wheel." In other embodiments (no shown), the narrow media-guiding roller 180 may have a plurality of grooves 84. When the media-guiding roller 180 is positioned adjacent to the web of receiver media 10, and the air source 86 is activated to direct airflow 90 into the groove 84 between the exterior surface 83 of the grooved media-guiding roller 180 and the receiver media 10, the low pressure zone that is generated as the air flows through the groove 84 creates a Bernoulli force on the receiver media 10, which causes the receiver media 10 to move into contact with (or to increase its contact with) the exterior surface 83 of the media-guiding roller 180. One application of such a media-guiding system 170 is as a web steering system. In the exemplary embodiment of FIG. 10, the media-guiding roller 180 and the air source 86 are mounted on a common frame 99. The frame 99 can be rotated around the vertical rotation axis 98 by an active steering system. By rotating the media-guiding roller 180 about the rotation axis 98, the direction of travel of the receiver media 10 can be altered. The active steering system can include a stepper motor 97 to rotate the frame 99 holding the media-guiding roller 180, in response to steering signals provided by a steering controller 95. In some embodiments, the steering controller 95 provides the steering signals in response to output signals from one or more media edge detectors 96. In this way, any drift in the cross-track position of the receiver media 10 can be corrected.

Figure 11:
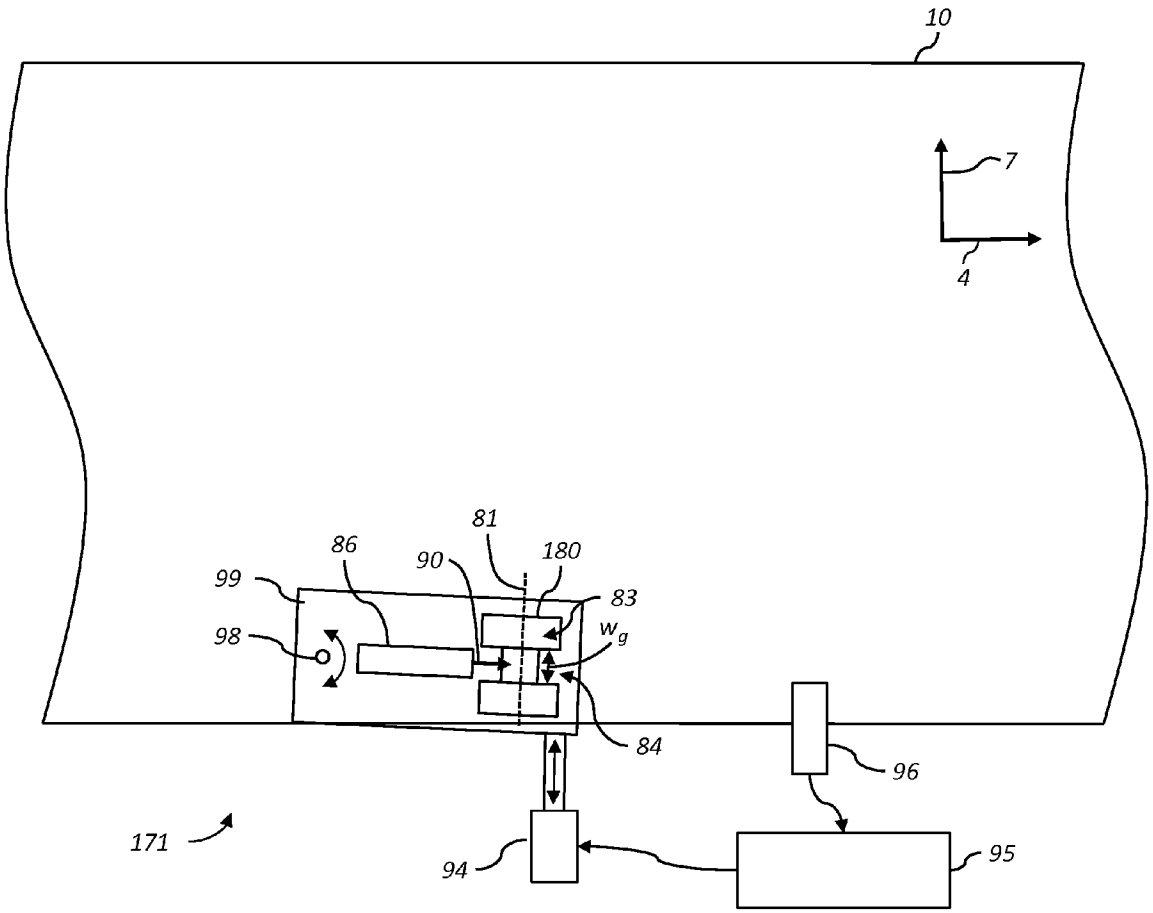
FIG. 11 illustrates a media-guiding system according to an alternate embodiment featuring a narrow media-guiding roller having a roller axis orientation that is adjusted using an actuator.

FIG. 11 shows another embodiment of a media guiding system 171, which is similar to that shown in FIG. 10. In this case, the frame 99 rotates around a rotation axis 98 toward the rear of the frame 99, and an actuator 94 is used to steer the media-guiding roller 180 in response to signals received from the steering controller 95.

Figure 12:
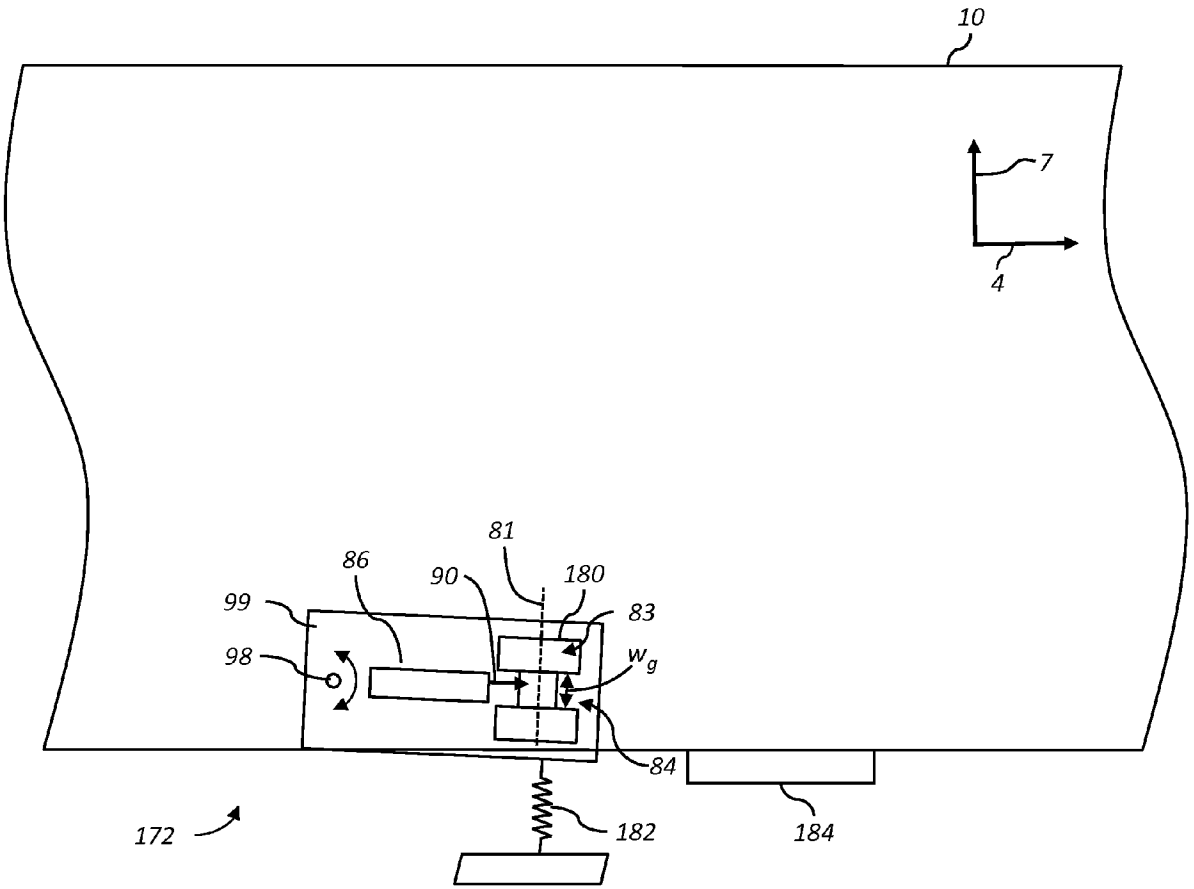
FIG. 12 illustrates a media-guiding system according to an alternate embodiment where a narrow media-guiding roller is used to pull the receiver media against an edge stop to control the cross-track position of the receiver media.

FIG. 12 shows another embodiment of a media guiding system 172. In the case, the frame 99 on which the media-guiding roller 180 is mounted is castered and is biased using a spring 182 to skew the roller axis 81 of the media-guiding roller 180 relative to the in-track direction 4 of the receiver media 10. The airflow 90 through the groove 84 of the media-guiding roller 180 causes the receiver media 10 to have sufficient contact with the media-guiding roller 180 so that the skew of the media-guiding roller 180 causes the receiver media 10 to be pushed against an edge stop 184, thereby accurately maintaining the cross-track position of the receiver media 10.

Figure 13:
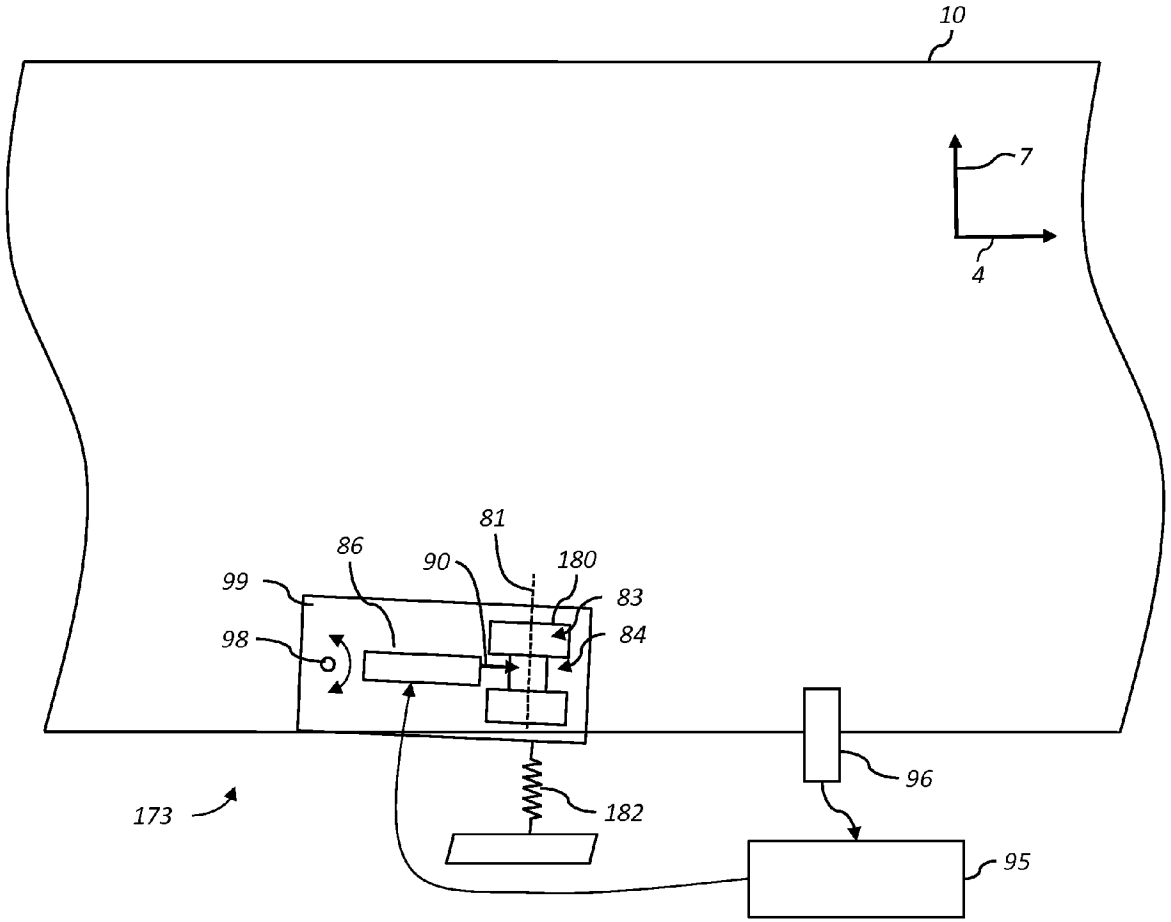
FIG. 13 illustrates a media-guiding system according to an alternate embodiment where the air flow provided to a narrow media-guiding roller is controlled responsive to a signal from a media edge detector.

FIG. 13 shows another embodiment of a media guiding system 173, which is similar to that shown FIG. 12 where the frame 99 on which the media-guiding roller 180 is mounted is castered and is spring biased to skew the media-guiding roller 180. In this case, one or more media edge detectors 96 provide signals to steering controller 95 related to the cross-track position of the receiver media 10. In response to the signals from the media edge detectors 96, the steering controller 95 generates signals to alter the cross-track position of the receiver media 10. In this embodiment, rather than providing signals to vary the skew of the media-guiding roller 180, the steering controller 95 provides signals to alter the airflow 90 provided by the air source 86. When no airflow 90 is provided, the receiver media 10 doesn't contact the media-guiding roller 180 so that the skewed media-guiding roller 180 has no effect on the cross-track position of the receiver media 10. When a sufficient rate of airflow 90 is provided through the groove 84 of the media-guiding roller 180, the receiver media 10 is pulled into contact with the exterior surface 83 of the media-guiding roller 180 such that the media-guiding roller 180 moves with minimal slip relative to the receiver media 10. The skew on the media-guiding roller 180 relative to the receiver media 10 therefore provides a significant lateral force bias to shift the receiver media 10 in the cross-track direction. At rates of airflow 90 between these two conditions, the skewed media-guiding roller 180 provides intermediate amounts of lateral force to the receiver media 10. In this way, the steering controller 95 is able to control the amount of lateral force applied to the receiver media 10 by controlling the rate of airflow 90 provided by the air source 86.

Figure 14:
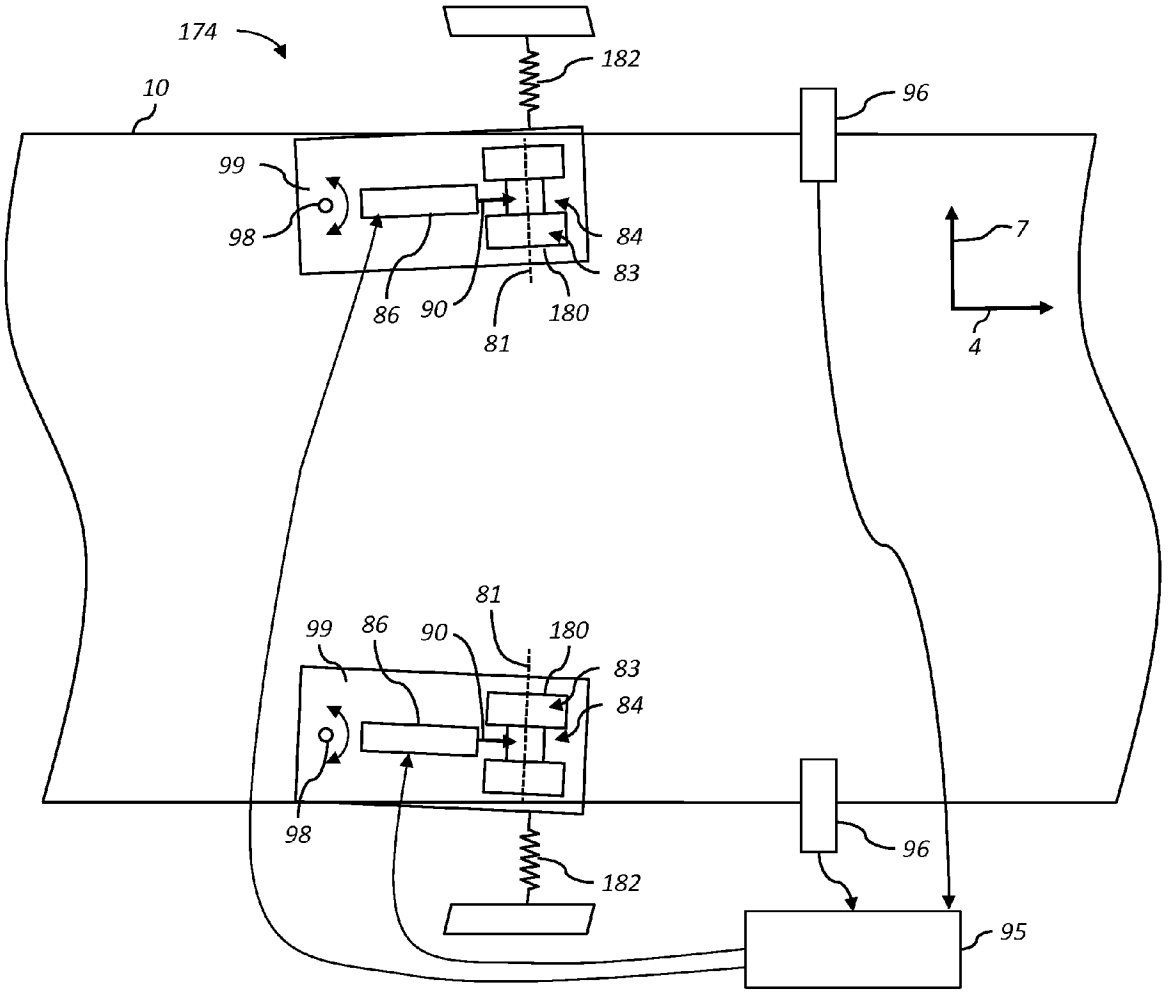
FIG. 14 illustrates a media-guiding system according to an alternate embodiment where the air flow provided to two narrow media-guiding rollers is controlled responsive to signals from one or more media edge detectors.

FIG. 14 shows another embodiment of a media guiding system 174 having two media-guiding rollers 180, each located near an edge of the receiver media 10 and each skewed outward relative to direction of media travel (i.e., the in-track direction 4). Like the media-guiding rollers 180 in FIGS. 10-13, the width of both media-guiding rollers 180 in the cross-track direction 7 spans only a relatively small fraction (e.g., less than 20%) of the cross-track width of the receiver media 10. The steering controller 95 receives signals from one or more media edge detectors 96. Based on the sensed cross-track position of the receiver media 10, the steering controller 95 sends signals to the air sources 86 associated with the two media-guiding rollers 180 to adjust the rate of airflow 90 into the grooves 84 in the two media-guiding rollers 180. By directing a sufficient airflow 90 into the groove 84 of a selected one of the skewed media-guiding rollers 180, the receiver media 10 can be made to contact and have traction with that media-guiding roller. The receiver media 10 is thereby steered in a corresponding cross-track direction.

Figure 15:
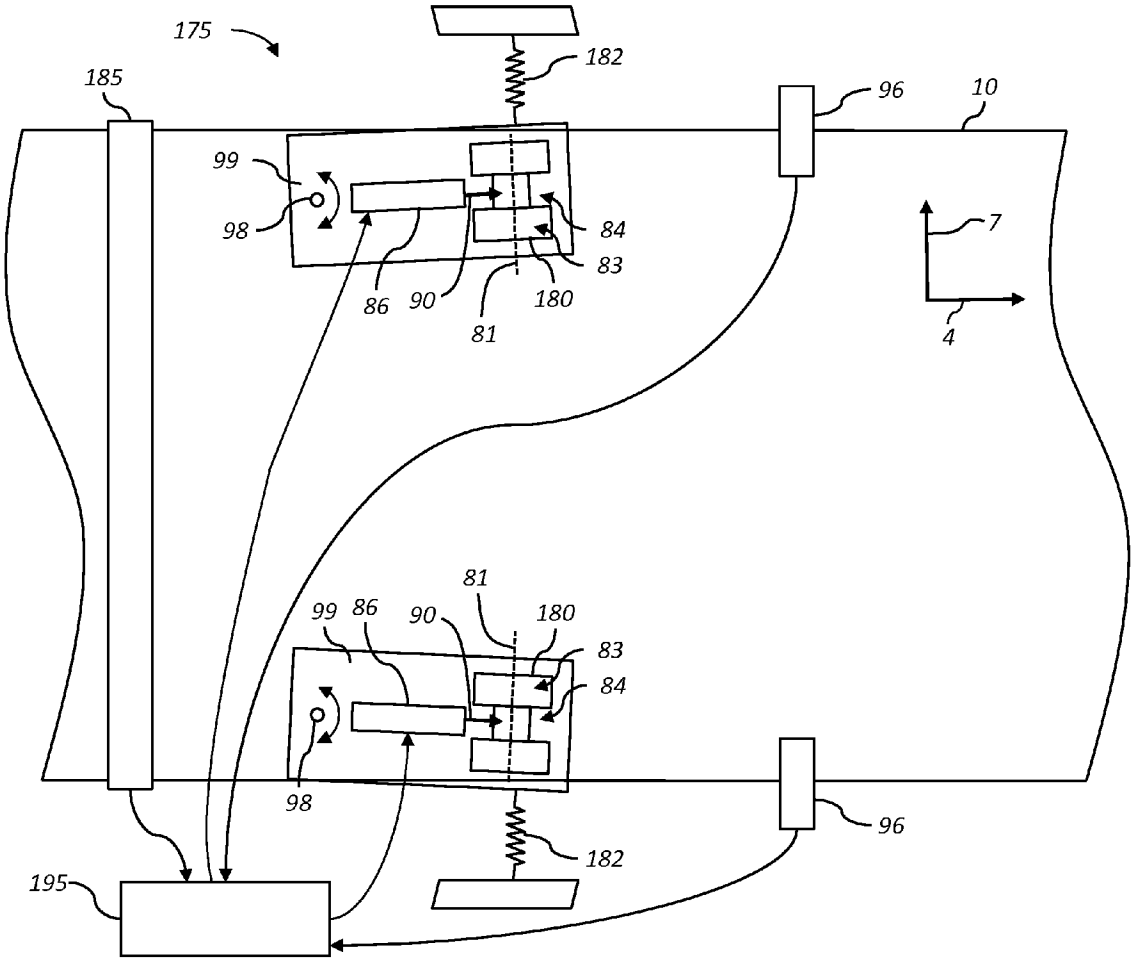
FIG. 15 illustrates a wrinkle-reduction system which uses two narrow media-guiding rollers to provide a stretching force to the receiver media.

FIG. 15 shows another embodiment of a media-guiding system 175 useful for providing a wrinkle-reduction feature. Like the previous embodiment shown in FIG. 14, this system has two media-guiding rollers 180, each skewed outward relative to the direction of media travel (i.e., in-track direction 4). In this case, a controller 195 controls the airflow 90 of the two air sources 86 in a balanced manner so both air sources 86 provide a similar amount of airflow 90. At sufficient rates of airflow 90 from the air sources 86, the receiver media 10 is drawn down into good contact with exterior surfaces 83 of the grooved media-guiding rollers 180. As the media-guiding rollers 180 are skewed away from each other, the media-guiding rollers 180 each apply a lateral force on the receiver media 10 to laterally spread the receiver media 10, thereby providing a wrinkle reduction process. When no airflow 90 is provided from either of the air sources 86, no spreading force is applied on the receiver media 10. By controlling the airflow 90 to intermediate air flow rates, the media-guiding system 175 can produce intermediate levels of spreading force on the receiver media 10. In some embodiments, the controller 195 receives signals from a flute detection system 185.

The flute detection system 185 can use any method known in the art to detect the presence of any flutes (also known as wrinkles or ripples) in the receiver media 10. Preferably the flute detection system 185 detects the height and spacing of any detected flutes. In an exemplary embodiment, the flute detection system 185 uses laser triangulation to detect and characterize any ripples or flutes in the receiver media 10. In an alternate embodiment, the flute detection system 185 projects a grating pattern onto the receiver media 10 from one angle and the projected grating pattern on the receiver media 10 is viewed, typically with a digital camera, from a different angle; a procedure known as fringe projection or projection moiré interferometry. Any distortion in the surface of the receiver media 10 causes the viewed grating lines to be warped, enabling any flutes to be easily detected. In an another alternate embodiment, the receiver media 10 can be illuminated by a light source at a low incidence angle, and a digital imaging system can be used to capture an image of the receiver media 10. In this case, the sides of the flutes facing the light source will show up as lighter regions, while the sides of the flutes facing away from the light source will show up as darker regions.

Based on the detection of flutes (i.e., wrinkles), including the height and spacing of flutes, the controller 195 adjusts the rate of airflow 90 to control the degree of spreading of the receiver media 10 to keep the fluting below an acceptable level. For example, the rate of airflow 90 can be increased to a higher level when larger flutes are detected relative to when smaller flutes are detected.

In another embodiment (not shown), force sensors attached to the media-guiding rollers 180 measure the lateral force applied by the media-guiding rollers 180 on the receiver media 10. The controller 195 regulates the airflow 90 provided by air sources 86 such that the spreading force doesn't exceed the tensile strength of the receiver media 10. As the tensile force applied by the receiver media 10 on the media-guiding rollers 180 will be low until the receiver media 10 has been spread sufficiently to flatten the ripples and fluting of the receiver media 10, the output of the force sensors attached to the media-guiding rollers 180 can be analyzed to detect when a sufficient spreading force has been applied to the receiver media 10 to sufficiently flatten the flutes, and the airflow 90 can be controlled to maintain the desired level of spreading force.

In some embodiments, the two media-guiding rollers 180 in FIG. 15 can be controlled to provide both the media spreading function described above together with the steering function described with respect to FIG. 14. In this case, the amount of airflow 90 provided by one air source 86 can be adjusted to be larger than that provided by the other air source 86 to steer the receiver media 10 in response to signals from one or more media edge detectors 96, while still providing a spreading force on the receiver media 10.

In some embodiments, the tilt angle of the roller axes 81 of the media-guiding rollers 180 can also be controlled (e.g., using the actuator mechanism shown in FIG. 11). By independently controlling the tilt angles, the media-guiding rollers 180 can be used to both steer the receiver media 10, as well as to provide a stretching force to reduce media wrinkling.

In an alternate embodiment, the two media-guiding rollers 180 in FIG. 15 can be skewed inward relative to the direction of media travel (i.e., in-track direction 4). In this way, the media-guiding rollers 180 can provide a compressing force to the receiver media 10 in the cross-track direction. Such an embodiment can be used to introduce a buckle into the receiver media, in preparation, for example, for a folding operation.

In some embodiments, the tilt angle of the roller axes 81 of the media-guiding rollers 180 can also be controlled (e.g., using the actuator mechanism shown in FIG. 11). By independently controlling the tilt angles, the media-guiding rollers 180 can be used to both steer the receiver media 10, as well as to provide a stretching force or a compressive force to the receiver media 10. For example, if both media-guiding rollers 180 are tilted outward with tilt angles of the same magnitude, a stretching force will be provided to the receiver media 10. However, if one of the media-guiding rollers 180 is tilted outward with a larger tilt angle, then the receiver media 10 can be steered while still providing a stretching force.

While the above embodiments of Bernoulli-force media-guiding rollers 80, 180 have been described with respect to printing systems 100, 110 configured to print on a continuous web of receiver media 10, it will be obvious to one skilled in the art that the disclosed Bernoulli-force media-guiding rollers can also be used in media-guiding systems for cut sheets of media. In some embodiments, the Bernoulli-force media-guiding rollers can be used in cut sheet media transports for operations such as cross-track steering and cross-track spreading of cut sheets, which are similar to the analogous operations which have been discussed above for web-fed media transports. In other embodiments, the Bernoulli-force media-guiding rollers of the present invention can also be used to alter the path taken by a sheet of media.

Figure 16A:
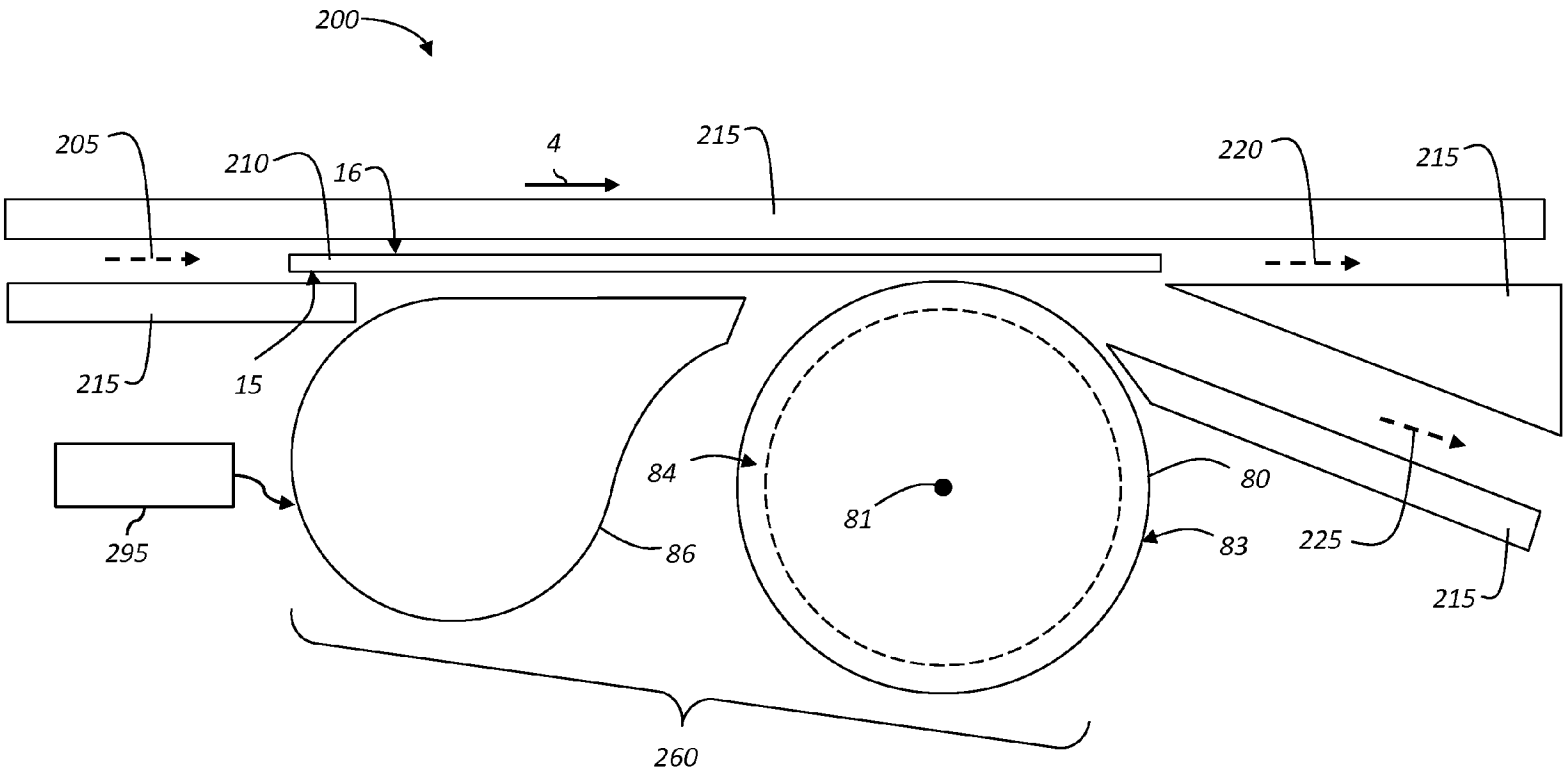
FIGS. 16A-16B illustrate a sheet-diverter system which uses a media-guiding roller to direct a media sheet into one of two media paths.
Figure 16B:
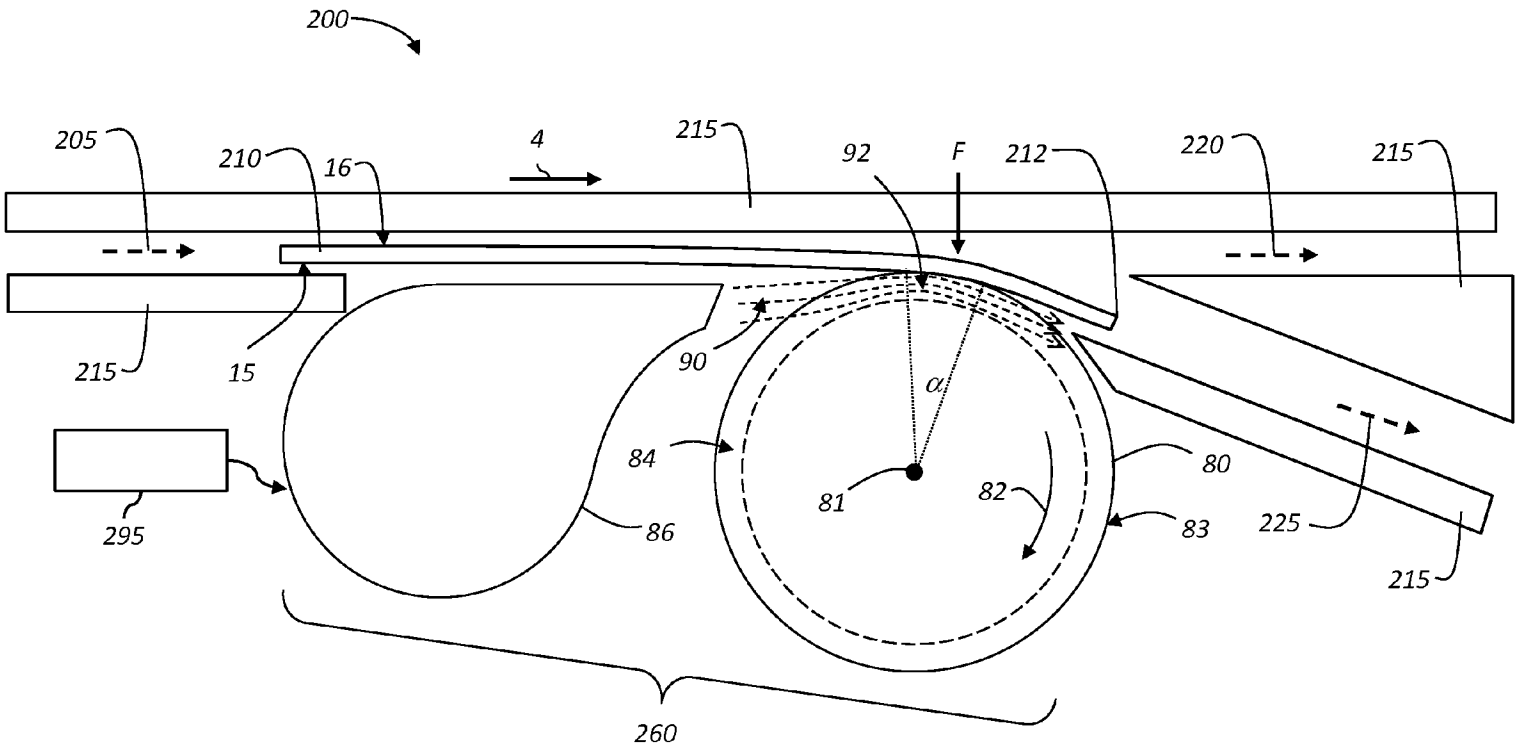

FIGS. 16A-16B illustrate an embodiment of a sheet-diverter system 200 in which a media sheet 210 traveling horizontally in in-track direction 4 is diverted either upward or downward with respect to the in-track direction 4 and guided into either an upper media path 220 or a lower media path 225, respectively, by selective activation of the air source 86 in a roller assembly 260, wherein the roller assembly 260 includes both an air source 86 and a media-guiding roller 80. The media sheet 210 is moved along an input media path 205 defined by media guides 215 using a media drive mechanism (not shown), such as drive rollers or a transport belt. FIG. 16A illustrates the case where the air source 86 is not activated. In this case, the media sheet 210 is undeviated as it passes by the media-guiding roller 80 and moves forward into the upper media path 220.

In FIG. 16B, the air source 86 has been activated by a controller 295 to provide an airflow 90 which is directed into the groove 84 in the media-guiding roller 80, and a motor (not shown) has been activated to drive the media-guiding roller 80 in the rotation direction 82. As discussed earlier, the flow of air through the constriction 92 produces a Bernoulli force F which pulls the first side 15 of the media sheet 210 down into contact with the exterior surface 83 of the media-guiding roller 80, entraining the media sheet 210 around the media-guiding roller 80 for some wrap angle $\alpha$. This causes leading edge 212 of the media sheet 210 to be diverted downward, bending the media sheet 210 and directing the media sheet 210 into the lower media path 225. In some embodiments, the motor driving the media-guiding roller 80 is activated continuously, even when the media sheet 210 is to be directed into the upper media path 220, but since the air source 86 is not activated, no Bernoulli force F is present to direct the media sheet 210 into contact with the media-guiding roller 80 and to direct it into the lower media path 220.

Figure 17:
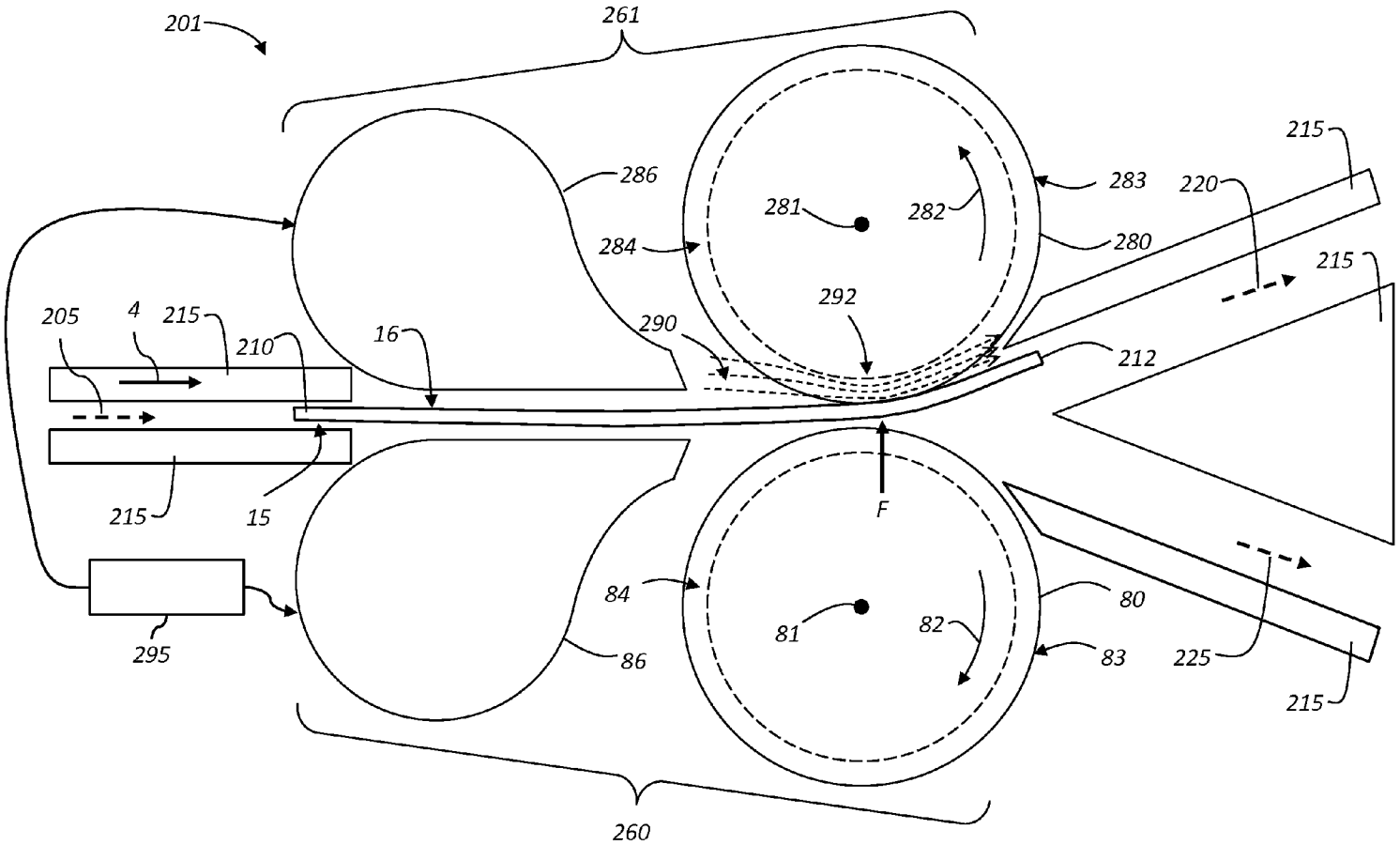
FIG. 17 illustrates a sheet-diverter system which uses two media-guiding rollers to direct a media sheet into one of two media paths.

FIG. 17 illustrates another embodiment of a sheet-diverter system 201 in which a media sheet 210 is guided into either an upper media path 220 or a lower media path 225. In this case, a second roller assembly 261, including a second upper air source 286 and a second upper media-guiding roller 280, is provided facing the second side 16 of the media sheet 210. The upper media-guiding roller 280 has one or more grooves 284 formed into its external surface 283, and rotates around a roller axis 281 in a rotation direction 282. The rotation direction 282 is opposite to the rotation direction 82 of the first media-guiding roller 80. The controller 295 controls which media path that the media sheet 210 by selectively activating the corresponding air source 86, 286. As in FIG. 16B, the lower air source 86 can be activated to divert the media sheet 210 into the lower media path 225. However, to divert the media sheet 210 into the upper media path 220, the upper air source 286 is activated to provide an airflow 290 into the groove 284 in the upper media-guiding roller 280, and a motor (not shown) is activated to drive the media-guiding roller 280 in the rotation direction 282. The flow of air through the constriction 292 produces a Bernoulli force F which pulls the second side 16 of the media sheet 210 up into contact with the exterior surface 283 of the media-guiding roller 280, entraining the media sheet 210 around the media-guiding roller 280. This causes the leading edge 212 of the media sheet 210 to be diverted upward, bending the media sheet 210 and directing the media sheet 210 into the upper media path 220. In some embodiments, the motors driving both media-guiding rollers 80, 280 are activated continuously, even when the media sheet 210 is to be directed into the other media path.

Figure 18:
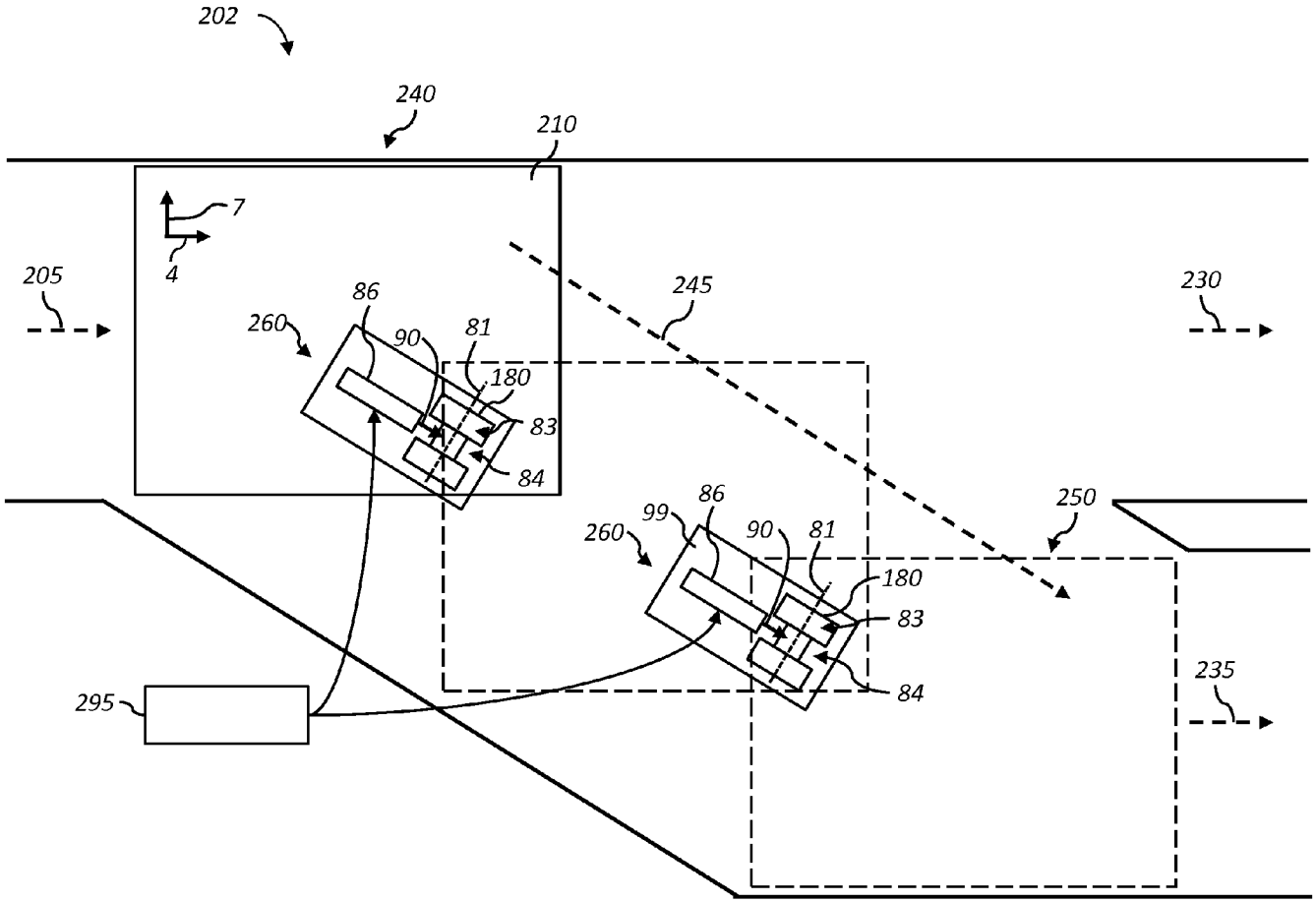
FIG. 18 illustrates a sheet-diverter system which uses media-guiding rollers to direct a media sheet a left or right media path.

The embodiments of FIGS. 16-17 are directed to diverting a media sheet 210 vertically into either an upper media path 220 or a lower media path 225. FIG. 18 illustrates another embodiment of a sheet-diverter system 202 which uses media-guiding rollers 180 to divert a media sheet 210 laterally to direct it into either a left media path 230 or a right media path 235. In this configuration, the media sheet 210 travels along an input media path 205 using a media drive mechanism (not shown), such as drive rollers or a transport belt.

When the media sheet 210 reaches a transfer position 240, it can be directed into either the left media path 230 or the right media path 235. To direct the media sheet 210 into the left media path 230, controller 295 leaves the air sources 86 in a deactivated state. The media sheet 210 will then continue in an undeviated direction and will move into the left media path 230. To divert the media sheet 210 into the right media path 235, the controller 295 activates the air sources 86 in the roller assemblies 260 when the media sheet 210 reaches the transfer position 240. As discussed above, directing the airflow 90 from the air sources 86 through the grooves 84 in the media-guiding rollers 180 causes the media sheet 210 to be drawn down into contact with the rotating media-guiding rollers 180 by a Bernoulli force. The resulting traction will cause the media sheet 210 to be moved by the media-guiding rollers 180 along a media diversion path 245 until it reaches a shifted position 250, which is laterally shifted relative to the input media path 205, at which time the air sources 86 are deactivated by the controller 295. The media sheet 210 can then proceed along the right media path 235 using any appropriate media drive mechanism (not shown).

The direction of the media diversion path 245 is determined by the orientation of the roller assemblies 260. Generally, the direction of the media diversion path 245 will be perpendicular to the direction of the roller axis 81, and parallel to the direction of the groove 84. In the illustrated embodiment, the media diversion path 245 is angled at approximately 30° relative to the in-track direction 4, however, this is not a requirement. In other embodiments, different directions can be used for the media diversion path 245 as long as the direction includes a lateral component. For example, in some embodiments, the roller assemblies 260 can be oriented such that the rotation axis 81 is parallel to the in-track direction 4. In this case, the direction of the media diversion path 245 will be perpendicular to the in-track direction 4, and will therefore have only a lateral component and will have no forward component.

Typically, media sensors (not shown) are used to detect when the media sheet 210 has reached the transfer position 210 and the shifted position 250. Signals from the media sensors are fed into the controller 295 and are used to determine the times that the air sources 86 are activated and deactivated.

The illustrated embodiment shows roller assemblies 260 are positioned at different points along the media diversion path 245. They are spaced such that at least one of the media-guiding rollers 180 will be in contact with the media sheet 210 at all times as it moves along the media diversion path 245. In other embodiments, a single media-guiding roller 180 can be used, or more than two media-guiding rollers 180 can be used, depending on the geometry of the media diversion path.

In the illustrated embodiment, the media-guiding rollers 180 are used to divert the media sheet 210 into the right media path 235, which is shifted laterally to the right of the input media path 205. It will be obvious to those skilled in the art that in other embodiments the left media path 230 can be shifted laterally to the left of the input media path 205 and the media-guiding rollers 180 can be oriented to divert the media sheet 210 into the left media path 235. In other embodiments, different sets of media-guiding rollers 180 that are oriented in different directions to direct the media sheet 210 into a plurality of media paths at different lateral positions. It will be obvious to one skilled in the art that this same approach can be extended to direct the media sheet 210 into more than two media paths.

Figure 19:
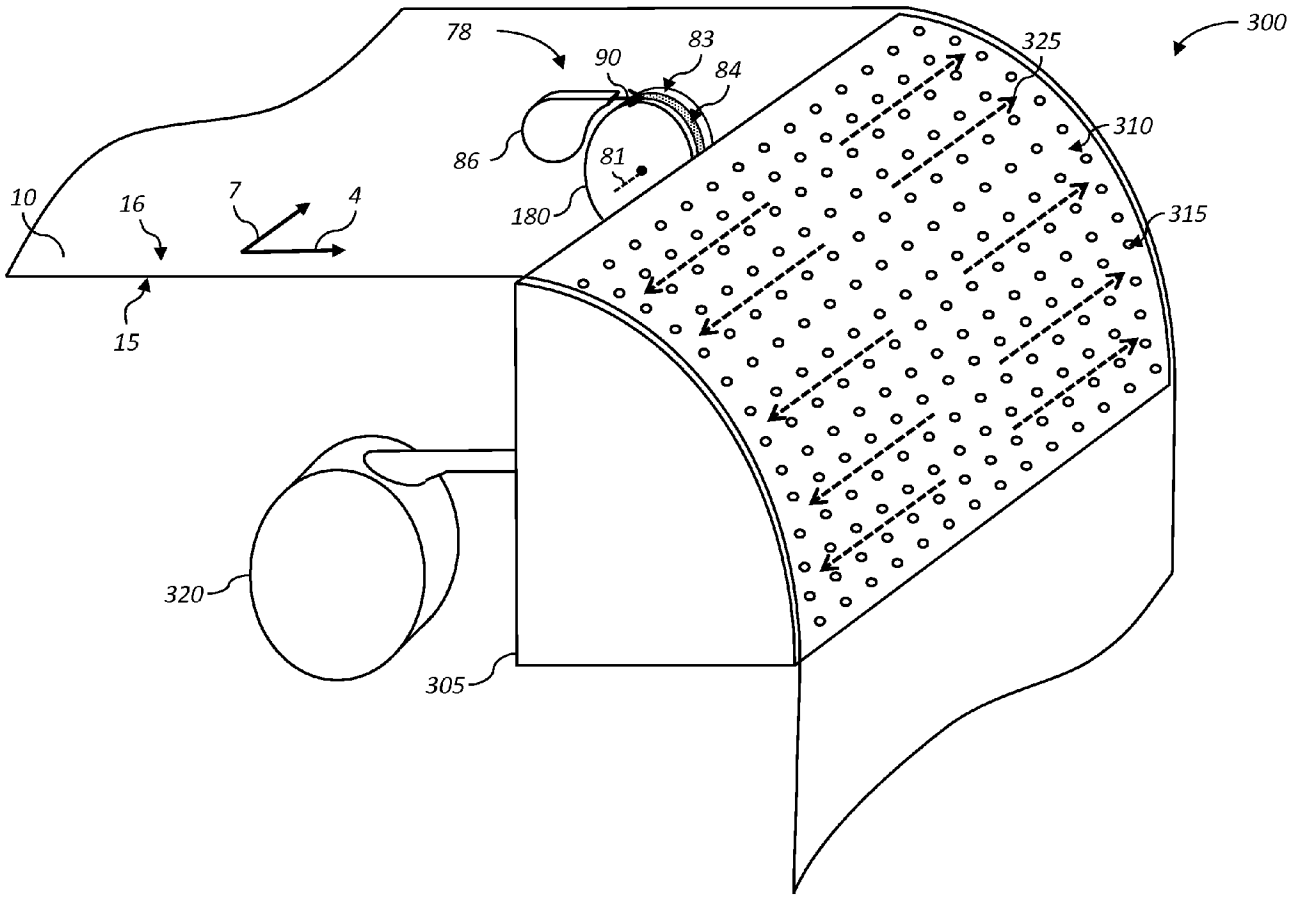
FIG. 19 is a perspective diagram illustrating a web-guiding system which includes a grooved web-guiding roller providing a Bernoulli force and a fixed web-guiding structure in accordance with an alternate embodiment.

FIG. 19 shows an exemplary embodiment of a web-guiding system 300 that includes a media-guiding system 78 as described earlier, together with an air shoe. The air shoe includes a fixed web-guiding structure 305 having a convex exterior surface 310. The fixed web-guiding structure 305 is "fixed" in the sense that it doesn't rotate or move with a surface speed that corresponds to the surface speed of the web of receiver media. The fixed web-guiding structure 305 being "fixed" is not intended to indicate that orientation of the fixed web-guiding structure 305 cannot be adjusted, either actively or passively, to align the fixed web-guiding structure 305 relative to the transport path of the receiver media 10. In the illustrated embodiment first side 15 of the receiver media 10 faces the exterior surface 310 of the fixed web-guiding structure 305, while second side 16 faces away from the fixed web-guiding structure 305.

A pattern of air holes 315 is formed through the exterior surface 310 of the fixed web-guiding structure 305, through which air 325 supplied by an air source 320 can flow. As the web of receiver media 10 travels around the fixed web-guiding structure 305, the flow of air 325 through the air holes 315 serves as an air bearing lifting the web of receiver media 10 away from the fixed web-guiding structure 305 such that first side 15 of the web of receiver media 10 is substantially not in contact with the fixed web-guiding structure 305. Within the context of the present disclosure, "substantially not in contact" means that the receiver media 10 contacts less than 5% of the exterior surface 310 of the fixed web-guiding structure 305 that is adjacent to the receiver media 10. (The fixed web-guiding structure 305 is sometimes referred to in the art as an "air shoe" or an "air bearing structure.")

As the web of receiver media 10 is supported by the air 325 so that there is minimal contact between the receiver media 10 and the exterior surface 310 of the fixed web-guiding structure 305, the receiver media 10 has minimal friction with the fixed web-guiding structure 305. As a result, the receiver media 10 can pass over the fixed web-guiding structure 305 without scuffing the receiver media 10. Furthermore, the transverse bending of the web of receiver media 10 as it goes around the fixed web-guiding structure 305 tends to flatten the web of receiver media 10. The lack of angular constraint on the receiver media 10 allows the receiver media 10 to spread laterally to enable the flattening of the web. The fixed web-guiding structure 305 can therefore accommodate large wrap angles of the receiver media 10 without wrinkling.

Because the receiver media 10 has minimal friction with the fixed web-guiding structure 305, it provides little or no lateral constraint to impede the lateral (i.e., cross-track) movement of the web of receiver media 10. Therefore, while the low friction is beneficial for inhibiting the formation of wrinkles, it has the detrimental effect of allowing the print media to drift in the cross-track direction 7. The media-guiding system 78, including media-guiding roller 180 and air source 86, is used to provide a lateral constraint on the receiver media 10 by placing it in close proximity to the fixed web-guiding structure 305 to inhibit cross-track drift or wander of the receiver media 10.

Figure 20A:
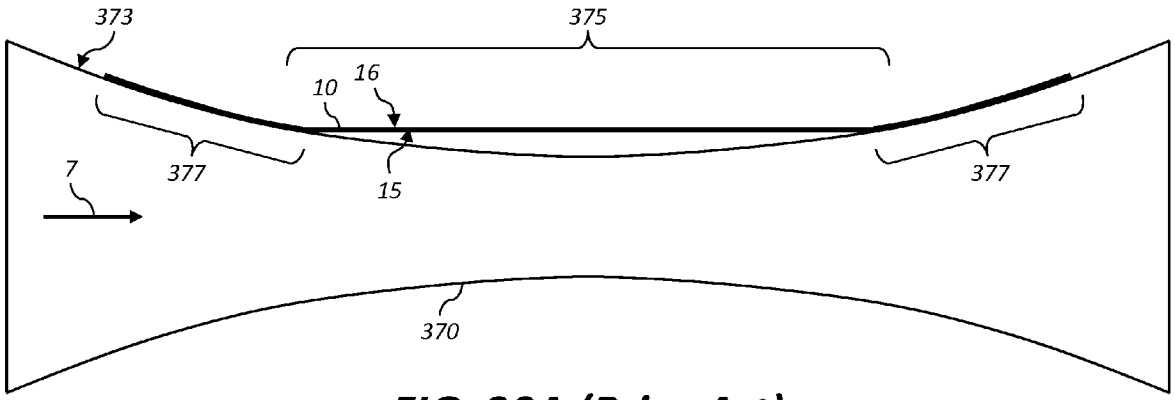
FIG. 20A (Prior Art)
FIG. 20A illustrates a prior art concave media-guiding roller.

FIG. 20A shows a cross-section (taken in the cross-track direction 7) of a prior art concave media-guiding roller 370. Such concave media-guiding rollers 370 are known in the art to produce a spreading force on the web of receiver media 10 is it moves past the concave media-guiding roller 370. However, it has been found that in certain situations, such as when the media-guiding roller 370 has a large amount of concavity and a small wrap angle, that a central portion 375 of the receiver media 10 fails to make contact with the exterior surface 373 of the concave media-guiding roller 370, leaving a reduced contacting portion 377. This can have the undesirable effect of limiting the amount of media spreading provided by the concave media-guiding roller 370. Inventors have found that this problem can be overcome, or reduced in magnitude, by using an embodiment of the invention.

Figure 20B:
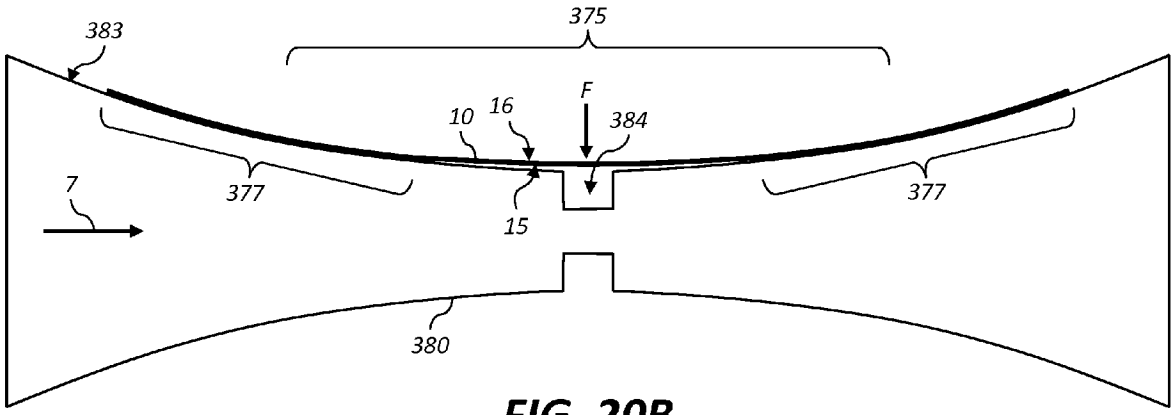
FIG. 20B illustrates a grooved concave media-guiding roller in accordance with an embodiment of the present invention.

FIG. 20B shows a cross-section (taken in the cross-track direction 7) of a concave media-guiding roller 380 in accordance with an embodiment of the present invention. In this configuration, one or more grooves 384 are formed in the central portion 375 of the exterior surface 383 of the concave media-guiding roller 380. As was discussed earlier with respect to FIG. 5, an air source 86 (not shown in FIG. 20B) is positioned to direct an airflow 90 (not shown in FIG. 20B) into the one or more grooves 384, the airflow 90 being directed between the first side 15 of the receiver media 10 and the exterior surface 383 of the concave media-guiding roller 380. This produces a Bernoulli force F on the central portion 375 of the receiver media 10 to deflect the central portion 375 of receiver media 10 toward the concave media-guiding roller 380. This results in an increased contacting portion 377 of the receiver media 10 being in contact with the exterior surface 383 of the concave media-guiding roller, when compared to the conventional concave media-guiding roller 370 shown in FIG. 20A. As a result, using a grooved concave media-guiding roller 380 in accordance with the invention can increase the spreading effect provided to the receiver media 10.

It will be obvious to one skilled in the art that in addition to guiding receiver media 10 through a printing system 100, the media guiding systems of the present invention can also be used to guide other types of media in other types of media transport systems. For example, the present invention can also be used to move various kinds of substrates through other types of systems such as media coating systems, or systems for performing various media finishing operations (e.g., slitting, folding or binding).

The invention has been described in detail with particular reference to certain preferred embodiments thereof, but it will be understood that variations and modifications can be effected within the spirit and scope of the invention.

PARTS LIST

2 roller
3 receiver media
4 in-track direction
5 flute
7 cross-track direction
8 contact surface
9 exit direction
10 receiver media
11 source roll
12 take-up roll
15 first side
16 second side
20*a* printhead
20*b* printhead
20*c* printhead
20*d* printhead
21 print line
22 print line
25*a* printhead
25*b* printhead
30 web-guiding system
31 print line roller
32 print line roller
40 dryer
41 dryer roller
45 quality control sensor
50 printing module
51 first zone
52 second zone
55 printing module
60 turnover mechanism
65 printing module
66 web-guiding structure
70 media-guiding roller
72 rotation direction
74 air cushion
76 entrained airflow
78 media-guiding system
79 media-guiding system
80 media-guiding roller
81 roller axis
82 rotation direction
83 exterior surface
84 groove
85 airflow guide
86 air source
88 air
89 openings
90 airflow
91 plenum
92 constriction
93 pivot arm
94 actuator
95 steering controller
96 media edge detector
97 stepper motor
98 rotation axis
99 frame
100 printing system
110 printing system
170 media-guiding system
171 media-guiding system
172 media-guiding system
173 media-guiding system
174 media-guiding system
175 media-guiding system
180 media-guiding roller
182 spring
184 edge stop
185 flute detection system
195 controller
200 sheet-diverter system
201 sheet-diverter system
202 sheet-diverter system
205 input media path
210 media sheet
212 leading edge
215 media guide
220 upper media path
225 lower media path
230 left media path
235 right media path
240 transfer position
245 media diversion path
250 shifted position
260 roller assembly
261 roller assembly
280 media-guiding roller
281 roller axis
282 rotation direction
283 exterior surface
284 groove
286 air source
290 airflow

292 constriction
295 controller
300 web-guiding system
305 fixed web-guiding structure
310 exterior surface
315 air holes
320 air source
325 air
370 concave media-guiding roller
373 exterior surface
375 central portion
377 contacting portion
380 concave media-guiding roller
383 exterior surface
384 groove
$d_a$ airflow depth
$d_g$ groove depth
F Bernoulli force
$w_g$ groove width
$\alpha$ wrap angle

The invention claimed is:

1. A wrinkle-reduction system for reducing wrinkles in a media travelling from upstream to downstream along a transport path in an in-track direction, the media having a first side and an opposing second side, comprising:

a first media-guiding roller having a first roller axis and an exterior surface having at least one groove formed around the exterior surface, wherein the media travels along the transport path past the first media-guiding roller with the first side of the media facing the exterior surface of the first media-guiding roller;

a first air source for providing an air flow into the at least one groove formed around exterior surface of the first media-guiding roller, the air flow being directed between the first side of the media and the exterior surface of the first media-guiding roller thereby producing a Bernoulli force to draw the media toward the exterior surface of the first media-guiding roller and providing an increased traction between the media and the first media-guiding roller;

a second media-guiding roller having a second axis and an exterior surface having at least one groove formed around the exterior surface, wherein the media travels along the transport path past the second media-guiding roller with the first side of the media facing the exterior surface of the second web-guiding roller; and a second air source for providing an air flow into the at least one groove formed around exterior surface of the second media-guiding roller, the air flow being directed between the first side of the media and the exterior surface of the second media-guiding roller thereby producing a Bernoulli force to draw the media toward the exterior surface of the second media-guiding roller and providing an increased traction between the media and the second media-guiding roller;

wherein the first media-guiding roller is located in proximity to a first edge of the media and the second media-guiding roller is located in proximity to an opposite second edge of the media, both the first and second media-guiding rollers have widths in the direction of their respective roller axis which are less than 20% of a cross-track width of the media; and wherein the first roller axis is not parallel to the second roller axis such that when the first and second air sources are activated the traction between the media and the first and second media-guiding rollers imparts a lateral stretching force to the media in the cross-track direction.

2. The wrinkle-reduction system of claim 1 further including a control system for selectively controlling a flow rate of the air flow provided by the first and second air sources to control an amount of traction between the media and the respective first and second media-guiding roller.

3. The wrinkle-reduction system of claim 2 further including flute detection system for detecting flutes present in the media, wherein the control system controls the flow rate of the air flow provided by the first and second air sources in response to a signal from the flute detection system.

4. The wrinkle-reduction system of claim 3 wherein the control system controls the flow rate of the air flow provided by the first and second air sources in response to a signal from the flute detection system indicating the size or spacing of any flutes detected in the media.

5. The wrinkle-reduction system of claim 2 further including a force sensor for sensing a tensile force applied to the media by the first and second media-guiding rollers, wherein the control system controls the flow rate of the air flow provided by the first and second air sources in response to a tensile force sensed by the force sensor.

6. The wrinkle-reduction system of claim 2 further including at least one media edge detector that detect a position of an edge of the media, and wherein the control system controls the flow rate of the air flow provided by the first and second air sources in response to a signal from the at least one media edge detector.

7. The wrinkle-reduction system of claim 6 wherein the control system controls the flow rate of the air flow provided by the first and second air sources such that the media is maintained in a substantially constant cross-track position.

8. The wrinkle-reduction system of claim 1 further including a roller control mechanism for adjusting the orientation of the first roller axis and the second roller axis relative to the in-track direction of the media.

9. The wrinkle-reduction system of claim 8 further including flute detection system for detecting flutes present in the media, wherein the roller control mechanism controls the orientation of the first roller axis and the second roller axis in response to a signal from the flute detection system.

10. The wrinkle-reduction system of claim 9 wherein the control system controls the orientation of the first roller axis and the second roller axis in response to a signal from the flute detection system indicating the size or spacing of any flutes detected in the media.

11. The wrinkle-reduction system of claim 8 further including a force sensor for sensing a tensile force applied to the media by the first and second media-guiding rollers, wherein the control system controls the orientation of the first roller axis and the second roller axis in response to a tensile force sensed by the force sensor.

12. The wrinkle-reduction system of claim 8 further including at least one media edge detector that detect a position of an edge of the media, and wherein the control system controls the orientation of the first roller axis and the second roller axis in response to a signal from the media edge detectors.

13. The wrinkle-reduction system of claim 12 wherein the control system controls the orientation of the first roller axis and the second roller axis such that the media is maintained in a substantially constant cross-track position.

14. The wrinkle-reduction system of claim 8 wherein the first and second media-guiding rollers are mounted to respective first and second frames, and wherein the roller control mechanism includes an actuator or a stepper motor that adjusts the orientation of the first roller axis and the second roller axis by rotating the respective frame around a rotation axis.

15. The wrinkle-reduction system of claim 1 wherein the media contacts the first and second media-guiding rollers for a wrap angle of less than 5 degrees.

16. The wrinkle-reduction system of claim 1 wherein media is a web of media.

17. The wrinkle-reduction system of claim 1 wherein the media is a cut sheet of media.

18. The wrinkle-reduction system of claim 1 further including a first drive mechanism that rotates the first media-guiding roller around the first roller axis and a second drive mechanism that rotates the second media-guiding roller around the second roller axis.

19. The wrinkle-reduction system of claim 1 wherein the air flow is directed into the at least one groove in a direction substantially parallel to the grooves.

* * * * *